US006399017B1

(12) United States Patent
Norville et al.

(10) Patent No.: US 6,399,017 B1
(45) Date of Patent: Jun. 4, 2002

(54) METHOD AND APPARATUS FOR CONTAINING AND EJECTING A THIXOTROPIC METAL SLURRY

(75) Inventors: Samuel M. D. Norville; Patrick J. Lombard; Shaupoh Wang, all of Jackson, TN (US)

(73) Assignee: AEMP Corporation, Jackson, TN (US)

( * ) Notice: Subject to any disclaimer, the term of this patent is extended or adjusted under 35 U.S.C. 154(b) by 0 days.

(21) Appl. No.: 09/585,296

(22) Filed: Jun. 1, 2000

(51) Int. Cl.[7] ..... C21C 1/00

(52) U.S. Cl. ..... 266/242; 266/275; 164/312

(58) Field of Search ..... 266/135, 241, 266/242, 275; 164/312

(56) References Cited

U.S. PATENT DOCUMENTS

| | | | | |
|---|---|---|---|---|
| 972,429 | A | 10/1910 | Baird | 266/241 |
| 1,506,281 | A | 8/1924 | Baily | 266/280 |
| 1,776,355 | A | 9/1930 | Eppensteiner | 266/280 |
| 3,472,502 | A | 10/1969 | Schott | 266/27 |
| 3,791,015 | A | 2/1974 | Lucenti | 29/401 |
| 3,840,364 | A | 10/1974 | Flemings et al. | 75/63 |
| 3,842,895 | A | 10/1974 | Mehrabian et al. | 164/49 |
| 3,882,923 | A | 5/1975 | Alberny et al. | |
| 3,902,544 | A | 9/1975 | Flemings et al. | 164/71 |
| 3,948,650 | A | 4/1976 | Flemings et al. | 75/135 |
| 3,951,651 | A | 4/1976 | Mehrabian et al. | 75/135 |
| 3,981,351 | A | 9/1976 | Dompass | 164/283 |
| 3,995,678 | A | 12/1976 | Zavaras et al. | |
| 4,088,295 | A | 5/1978 | Medovar et al. | 249/79 |
| 4,089,680 | A | 5/1978 | Flemings et al. | 75/129 |
| 4,108,643 | A | 8/1978 | Flemings et al. | 75/135 |
| 4,125,364 | A | 11/1978 | Stephens | 432/145 |
| 4,174,214 | A | 11/1979 | Bennett et al. | 75/168 R |
| 4,229,210 | A | 10/1980 | Winter et al. | 75/10 |

(List continued on next page.)

FOREIGN PATENT DOCUMENTS

| | | | |
|---|---|---|---|
| EP | 0 701 002 | A1 | 3/1996 |
| EP | 0710 515 | A1 | 5/1996 |
| EP | 0 745 694 | A1 | 12/1996 |
| EP | 0 841 406 | A1 | 5/1998 |
| EP | 0 903 193 | A1 | 3/1999 |
| GB | 2 042 386 | A | 9/1980 |
| JP | 61-67555 | | 4/1986 |
| JP | 1-192446 | | 8/1989 |
| JP | 6-28939 | | 2/1994 |
| WO | WO95/19237 | | 7/1995 |
| WO | WO98/23403 | | 6/1998 |
| WO | WO 98/30346 | | 7/1998 |
| WO | WO99/50007 | | 10/1999 |
| WO | WO00/05015 | | 2/2000 |

OTHER PUBLICATIONS

"Semisolid Metal Process Eliminates Preformed Billets", by Samuel D. Norville, *Die Casting Management*, Mar. 1998, pp. 31–33.

*Primary Examiner*—Scott Kastler
(74) *Attorney, Agent, or Firm*—Woodard, Emhardt, Naughton, Moriarty & McNett

(57) ABSTRACT

A container system including a vessel for holding a thixotropic semi-solid aluminum alloy slurry during its processing as a billet and an ejection system for cleanly discharging the processed thixotropic semi-solid aluminum billet. The crucible is preferably formed from a chemically and thermally stable material. The crucible defines a mixing volume. The crucible ejection mechanism may include a movable bottom portion mounted on a piston or may include a solenoid coil for inducing an electromotive force in the electrically conducting billet for urging it from the crucible. During processing, a molten aluminum alloy precursor is transferred into the crucible and vigorously stirred and controlledly cooled to form a thixotropic semi-solid billet. Once the billet is formed, the ejection mechanism is activated to discharge the billet, from the crucible. The billet is discharged onto a shot sleeve and immediately placed in a mold and molded into a desired form.

13 Claims, 18 Drawing Sheets

U.S. PATENT DOCUMENTS

| | | | | |
|---|---|---|---|---|
| 4,321,958 | A | 3/1982 | Delassus | 164/504 |
| 4,345,637 | A | 8/1982 | Flemings et al. | 164/113 |
| 4,415,374 | A | 11/1983 | Young et al. | 148/2 |
| 4,434,837 | A | 3/1984 | Winter et al. | 164/468 |
| 4,450,893 | A | 5/1984 | Winter et al. | 164/468 |
| 4,457,354 | A | 7/1984 | Dantzig et al. | 164/468 |
| 4,457,355 | A | 7/1984 | Winter et al. | 164/468 |
| 4,465,118 | A | 8/1984 | Dantzig et al. | 164/452 |
| 4,482,012 | A | 11/1984 | Young et al. | 165/146 |
| 4,494,461 | A | 1/1985 | Pryor et al. | 102/464 |
| 4,510,987 | A | 4/1985 | Collot | |
| 4,523,624 | A | 6/1985 | Dantzig et al. | 164/454 |
| 4,524,820 | A | 6/1985 | Gullotti et al. | 164/476 |
| 4,530,404 | A | 7/1985 | Vives | 164/467 |
| 4,555,272 | A | 11/1985 | Ashok et al. | 148/3 |
| 4,565,241 | A | 1/1986 | Young | 164/499 |
| 4,569,218 | A | 2/1986 | Baker et al. | 72/342 |
| 4,607,682 | A | 8/1986 | Dantzig et al. | 164/418 |
| 4,614,225 | A | 9/1986 | Ernst et al. | 164/504 |
| RE32,529 | E | 10/1987 | Vives | 164/467 |
| 4,709,746 | A | 12/1987 | Young et al. | 164/485 |
| 4,712,413 | A | 12/1987 | Koch | 72/361 |
| 4,729,422 | A | 3/1988 | Ernst et al. | 164/468 |
| 4,774,992 | A | 10/1988 | George | 164/122.1 |
| 4,838,988 | A | 6/1989 | Lang et al. | 156/624 |
| 4,877,079 | A | 10/1989 | Long et al. | 164/468 |
| 5,098,487 | A | 3/1992 | Brauer et al. | 148/432 |
| 5,135,564 | A | 8/1992 | Fujikawa et al. | 75/10.14 |
| 5,219,018 | A | 6/1993 | Meyer | 164/468 |
| 5,247,988 | A | 9/1993 | Kurzinski | 164/485 |
| 5,332,200 | A | 7/1994 | Gorin et al. | 266/280 |
| 5,425,048 | A | 6/1995 | Heine et al. | 373/151 |
| 5,501,266 | A | 3/1996 | Wang et al. | 164/113 |
| 5,529,391 | A | 6/1996 | Kindman et al. | 366/145 |
| 5,549,732 | A | 8/1996 | Dube et al. | 75/331 |
| 5,585,067 | A | 12/1996 | Leroy et al. | 420/554 |
| 5,630,466 | A | 5/1997 | Garat et al. | 164/457 |
| 5,701,942 | A | 12/1997 | Adachi et al. | 164/71.1 |
| 5,899,567 | A | 5/1999 | Morris, Jr. | 366/274 |
| 5,900,080 | A | 5/1999 | Baldi et al. | 148/550 |
| 5,925,199 | A | 7/1999 | Shiina et al. | 148/538 |
| 6,003,590 | A | 12/1999 | Pavlicevic et al. | 164/468 |
| 6,021,842 | A | 2/2000 | Bulhoff et al. | 164/504 |
| 6,065,526 | A | 5/2000 | Kono | 164/113 |
| 6,165,411 | A * | 12/2000 | Adachi et al. | 266/135 |

* cited by examiner

METHOD AND APPARATUS FOR CONTAINING AND EJECTING A THIXOTROPIC METAL SLURRY

TECHNICAL FIELD OF THE INVENTION

The present invention relates generally to metallurgy, and, more particularly, to a method and apparatus for containing a metal melt while it is processed as a semi-solid thixotropic metallic slurry and for ejecting the thixotropic metallic slurry once it is processed.

BACKGROUND OF THE INVENTION

The present invention relates in general to an apparatus which is constructed and arranged for producing an "on-demand" semi-solid material for use in a casting process. Included as part of the overall apparatus are various stations which have the requisite components and structural arrangements which are to be used as part of the process. The method of producing the on-demand semi-solid material, using the disclosed apparatus, is included as part of the present invention.

More specifically, the present invention incorporates a high temperature and corrosion resistant container to hold the semi-solid material during processing and an electromagnetic ejection system to facilitate the transference of the semi-solid material from the container after processing. Also included are structural arrangements and techniques to discharge the semi-solid material directly into a casting machine shot sleeve. As used herein, the concept of "on-demand" means that the semi-solid material goes directly to the casting step from the vessel where the material is produced. The semi-solid material is typically referred to as a "slurry" and the slug which is produced as a "single shot" is also referred to as a billet.

It is well known that semi-solid metal slurry can be used to produce products with high strength, leak tight and near net shape. However, the viscosity of semi-solid metal is very sensitive to the slurry's temperature or the corresponding solid fraction. In order to obtain good fluidity at high solid fraction, the primary solid phase of the semi-solid metal should be nearly spherical.

In general, semi-solid processing can be divided into two categories; thixocasting and rheocasting. In thixocasting, the microstructure of the solidifying alloy is modified from dendritic to discrete degenerated dendrite before the alloy is cast into solid feedstock, which will then be re-melted to a semi-solid state and cast into a mold to make the desired part. In rheocasting, liquid metal is cooled to a semi-solid state while its microstructure is modified. The slurry is then formed or cast into a mold to produce the desired part or parts.

The major barrier in rheocasting is the difficulty to generate sufficient slurry within preferred temperature range in a short cycle time. Although the cost of thixocasting is higher due to the additional casting and remelting steps, the implementation of thixocasting in industrial production has far exceeded rheocasting because semi-solid feedstock can be cast in large quantities in separate operations which can be remote in time and space from the reheating and forming steps.

In a semi-solid casting process, generally, a slurry is formed during solidification consisting of dendritic solid particles whose form is preserved. Initially, dendritic particles nucleate and grow as equiaxed dendrites within the molten alloy in the early stages of slurry or semi-solid formation. With the appropriate cooling rate and stirring, the dendritic particle branches grow larger and the dendrite arms have time to coarsen so that the primary and secondary dendrite arm spacing increases a During this growth stage in the presence of stirring, the dendrite arms come into contact and become fragmented to form degenerate dendritic particles. At the holding temperature, the particles continue to coarsen and become more rounded and approach an ideal spherical shape. The extent of rounding is controlled by the holding time selected for the process. With stirring, the point of "coherency" (the dendrites become a tangled structure) is not reached. The semi-solid material comprised of fragmented, degenerate dendrite particles continues to deform at low shear forces.

When the desired fraction solid and particle size and shape have been attained the semi-solid material is ready to be formed by injecting into a die-mold or some other forming process. Solid phase particle size is controlled in the process by limiting the slurry creation process to temperatures above the point at which the solid phase begins to form and particle coarsening begins.

It is known that the dendritic structure of the primary solid of a semi-solid alloy can be modified to become nearly spherical by introducing the following perturbation in the liquid alloy near liquidus temperature or semi-solid alloy:

1) Stirring: mechanical stirring or electromagnetic stirring;
2) Agitation: low frequency vibration, high-frequency wave, electric shock, or electromagnetic wave;
3) Equiaxed Nucleation: rapid under-cooling, grain refiner;
4) Oswald Ripening and Coarsening: holding alloy in semi-solid temperature for a long time.

While the methods in (2)–(4) have been proven effective in modifying the microstructure of semi-solid alloy, they have the common limitation of not being efficient in the processing of a high volume of alloy with a short preparation time due to the following characteristics or requirements of semi-solid metals:

High dampening effect in vibration.

Small penetration depth for electromagnetic waves.

High latent heat against rapid under-cooling.

Additional cost and recycling problem to add grain refiners.

Natural ripening takes a long time, precluding a short cycle time.

While most of the prior art developments have been focused on the microstructure and rheology of semi-solid alloy, temperature control has been found by the present inventors to be one of the most critical parameters for reliable and efficient semi-solid processing with a comparatively short cycle time. As the apparent viscosity of semi-solid metal increases exponentially with the solid fraction, a small temperature difference in the alloy with 40% or higher solid fraction results in significant changes in its fluidity. In fact, the greatest barrier in using methods (2)–(4), as listed above, to produce semi-solid metal is the lack of stirring. Without stirring, it is very difficult to make alloy slurry with the required uniform temperature and microstructure, especially when the there is a requirement for a high volume of the alloy. Without stirring, the only way to heat/cool semi-solid metal without creating a large temperature difference is to use a slow heating/cooling process. Such a process often requires that multiple billets of feedstock be processed simultaneously under a pre-programmed furnace and conveyor system, which is expensive, hard to maintain, and difficult to control.

While using high-speed mechanical stirring within an annular thin gap can generate high shear rate sufficient to break up the dendrites in a semi-solid metal mixture, the thin gap becomes a limit to the process's volumetric throughput. The combination of high temperature, high corrosion (e.g. of molten aluminum alloy) and high wearing of semi-solid slurry also makes it very difficult to design, to select the proper materials and to maintain the stirring mechanism.

Prior references disclose the process of forming a semi-solid slurry by reheating a solid billet, formed by thixocasting, or directly from the melt using mechanical or electromagnetic stirring. The known methods for producing semi-solid alloy slurries include mechanical stirring and inductive electromagnetic stirring. The processes for forming a slurry with the desired structure are controlled, in part, by the interactive influences of the shear and solidification rates.

In the early 1980's, an electromagnetic stirring process was developed to cast semi-solid feedstock with discrete degenerate dendrites. The feedstock is cut to proper size and then remelt to semi-solid state before being injected into mold cavity. Although this magneto hydrodynamic (MHD) casting process is capable of generating high volume of semi-solid feedstock with adequate discrete degenerate dendrites, the material handling cost to cast a billet and to remelt it back to a semi-solid composition reduces the competitiveness of this semi-solid process compared to other casting processes, e.g. gravity casting, low-pressure die-casting or high-pressure die-casting. Most of all, the complexity of billet heating equipment, the slow billet heating process and the difficulties in billet temperature control have been the major technical barriers in semi-solid forming of this type.

The billet reheating process provides a slurry or semi-solid material for the production of semi-solid formed (SSF) products. While this process has been used extensively, there is a limited range of castable alloys. Further, a high fraction of solids (0.7 to 0.8) is required to provide for the mechanical strength required in processing with this form of feedstock. Cost has been another major limitation of this approach due to the required processes of billet casting, handling, and reheating as compared to the direct application of a molten metal feedstock in the competitive die and squeeze casting processes.

In the mechanical stirring process to form a slurry or semi-solid material, the attack on the rotor by reactive metals results in corrosion products that contaminate the solidifying metal. Furthermore, the annulus formed between the outer edge of the rotor blades and the inner vessel wall within the mixing vessel results in a low shear zone while shear band formation may occur in the transition zone between the high and low shear rate zones. There have been a number of electromagnetic stirring methods described and used in preparing slurry for thixocasting billets for the SSF process, but little mention has been made of an application for rheocasting.

The rheocasting, i.e., the production by stirring of a liquid metal to form semi-solid slurry that would immediately be shaped, has not been industrialized so far. It is clear that rheocasting should overcome most of limitations of thixocasting. However, in order to become an industrial production technology, i.e., producing stable, deliverable semi-solid slurry on-line (i.e., on-demand) rheocasting must overcome the following practical challenges: cooling rate control, microstructure control, uniformity of temperature and microstructure, the large volume and size of slurry, short cycle time control and the handling of different types of alloys, as well as the means and method of transferring the slurry to a vessel and directly from the vessel to the casting shot sleeve.

One of the ways to overcome above challenges, according to the present invention, is to apply electromagnetic stirring of the liquid metal when it is solidified into semi-solid ranges. Such stirring enhances the heat transfer between the liquid metal and its container to control the metal temperature and cooling rate, and generates the high shear rate inside of the liquid metal to modify the microstructure with discrete degenerate dendrites. It increases the uniformity of metal temperature and microstructure by means of the molten metal mixture. With a carefl design of the stirring mechanism and method, the stirring drives and controls a large volume and size of semi-solid slurry, depending on the application requirements. The stirring helps to shorten the cycle time by controlling the cooling rate, and this is applicable to all type of alloys, i.e., casting alloys, wrought alloys, MMC, etc.

While propeller type mechanical stirring has been used in the context of making a semi-solid slurry, there are certain problems and limitations. For example, the high temperature and the corrosive and high wearing characteristics of semi-solid slurry make it very difficult to design a reliable slurry apparatus with mechanical stirring. However, the most critical limitation of using mechanical stirring in rheocasting is that its small throughput cannot meet the requirements production capacity. It is also known that semi-solid metal with discrete degenerated dendrite can also be made by introducing low frequency mechanical vibration, high-frequency ultra-sonic waves, or electric-magnetic agitation with a solenoid coil. While these processes may work for smaller samples at slower cycle time, they are not effective in making larger billet because of the limitation in penetration depth. Another type of process is solenoidal induction agitation, because of its limited magnetic field penetration depth and unnecessary heat generation, it has many technological problems to implement for productivity. Vigorous electromagnetic stirring is the most widely used industrial process permits the production of a large volume of slurry. Importantly, this is applicable to any high-temperature alloys.

Two main variants of vigorous electromagnetic stirring exist, one is rotational stator stirring, and the other is linear stator stirring. With rotational stator stirring, the molten metal is moving in a quasi-isothermal plane, therefore, the degeneration of dendrites is achieved by dominant mechanical shear. U.S. Pat. No. 4,434,837, issued Mar. 6, 1984 to Winter, describes an electromagnetic stirring apparatus for the continuous making of thixotropic metal slurries in which a stator having a single two pole arrangement generates a non-zero rotating magnetic field which moves transversely of a longitudinal axis. The moving magnetic field provides a magnetic stirring force directed tangentially to the metal container, which produces a shear rate of at least 50 $sec^{-1}$ to break down the dendrites. With linear stator stirring, the slurries within the mesh zone are re-circulated to the higher temperature zone and remelted, therefore, the thermal processes play a more important role in breaking down the dendrites. U.S. Pat. No. 5,219,018, issued Jun. 15, 1993 to Meyer, describes a method of producing thixotropic metallic products by continuous casting with polyphase current electromagnetic agitation. This method achieves the conversion of the dendrites into nodules by causing a refusion of the surface of these dendrites by a continuous transfer of the cold zone where they form towards a hotter zone.

A part formed according to this invention will typically have equivalent or superior mechanical properties, particularly elongation, as compared to castings formed by a fully liquid-to-solid transformation within the mold, the latter castings having a dendritic structure characteristic of other casting processes.

It is known in the art that in addition to being relatively dense and heavy and to holding a great deal of heat, some molten metals are also quite corrosive. Aluminum, for example, is extremely corrosive in its molten state. A crucible or vessel for containing such a molten metal must necessarily be strong as well as resistant to corrosion and thermal degradation. If the metal is to be magnetically stirred as part of a process for forming a thixotropic semi-solid metal slurry in the crucible, it is important that the crucible be as transparent as possible to lines of magnetic force so that they may pass through the crucible with minimal obstruction.

It is also important to be able to readily remove the thixotropic metal slurry once it has been processed in the crucible. Due to its thixotropic nature, the slurry is maintained at a temperature just above its solidus or coherency point. Therefore, mechanical manipulation is problematic, since a slight increase in temperature through mechanical contact could radically lower the viscosity of the slurry, and a slight decrease in temperature could provoke the formation of a solid skin around the slurry or even bulk crystallization of the slurry.

Another problem with ejection of the slurry from the crucible is that thixotropic semi-solid metal slurries tend to adhere to the inner surface of crucibles. Drag at the crucible inner surface reduces the shear on the thixotropic slurry, producing a region of higher viscosity slurry adjacent the crucible inner surface. Also, the slurry tends to interlock with any present crucible porosity, further contributing to adherence to the crucible.

Moreover, once the thixotropic semi-solid slurry is removed from the crucible, there is the problem of residual metallic deposits on the crucible walls. These can be a source of impurities, such as insoluble metallic oxides. Further, if the crucible must handle more than one metallic composition, any residual metal can of itself be an impurity.

There is therefore a need for a crucible system capable of containing a molten metal billet for thixotropic processing and also capable of readily and cleanly ejecting the processed thixotropic semi-solid slurry. The present invention addresses this need.

SUMMARY OF THE INVENTION

The present invention relates to a container system including a vessel for holding a thixotropic semi-solid metallic slurry during its formation and an ejection system for cleanly discharging the processed thixotropic semi-solid metallic slurry. One form of the present invention includes a crucible made of a chemically and thermally stable material (such as graphite or a ceramic) crucible defining a mixing volume and having a movable bottom portion mounted on a piston. A liquid metal precursor is transferred into the crucible and vigorously stirred and controlledly cooled to form a thixotropic semi-solid billet. Once the billet is formed, the piston is activated to push the bottom of the crucible through the mixing volume to discharge the billet. The billet is pushed from the crucible into a shot sleeve and immediately placed in a mold (such as by injection) and molded into a desired form.

Another form of the present invention includes a chemically and thermally stable crucible having an open top and defining a mixing volume. An electromagnetic coil is positioned proximate the crucible. A liquid metal precursor is transferred into the crucible, vigorously stirred and controlledly cooled to form a thixotropic semi-solid billet. The electromagnetic coil is actuated by a high frequency AC current, inducing eddy currents in the outer surface of the billet to produce a layer of liquid metal. The electromagnetic coil also induces a radially inwardly directed compressive electromotive force on the billet. The billet, thereby compressed and having a lubricating melted outer layer, may be easily removed from the crucible onto the shot sleeve by means such as pushing the billet out with a plunger or tilting the crucible.

Yet another form of the present invention includes a chemically and thermally stable crucible formed from two half crucibles. The crucible is split by a plane oriented in parallel with the crucible central axis. The crucible is held together by a clamp, bolted flanges, or the like. A liquid metal precursor is transferred into the crucible, vigorously stirred and controlledly cooled to form a thixotropic semi-solid billet. The billet is discharged from the crucible by separating the two halves.

One object of the present invention is to provide an improved system for producing thixotropic semi-solid metallic slurries. Related objects and advantages of the present invention will be apparent from the following description.

DETAILED DESCRIPTION OF THE PREFERRED EMBODIMENT

Figure 2A:
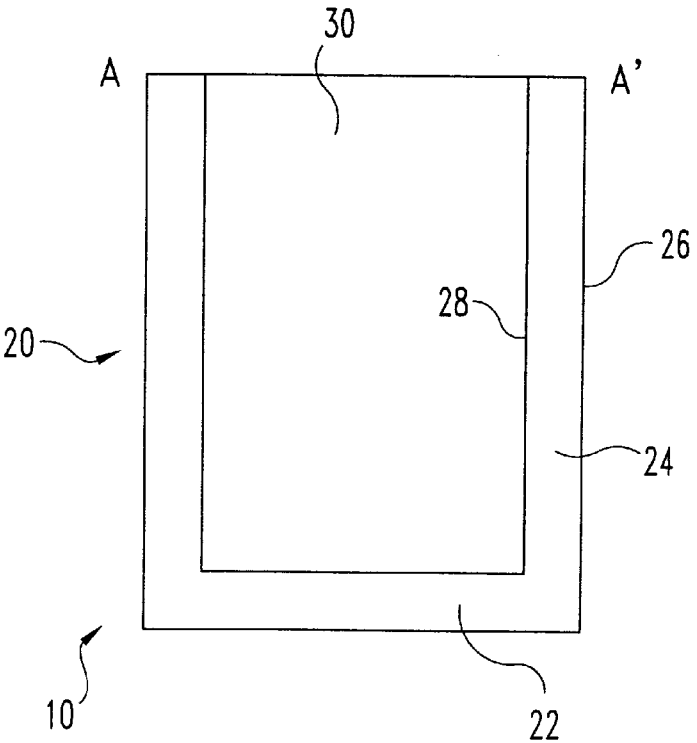
FIG. 2A is a sectional front elevational view of FIG. 1 taken along line A–A'.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

Figure 1:
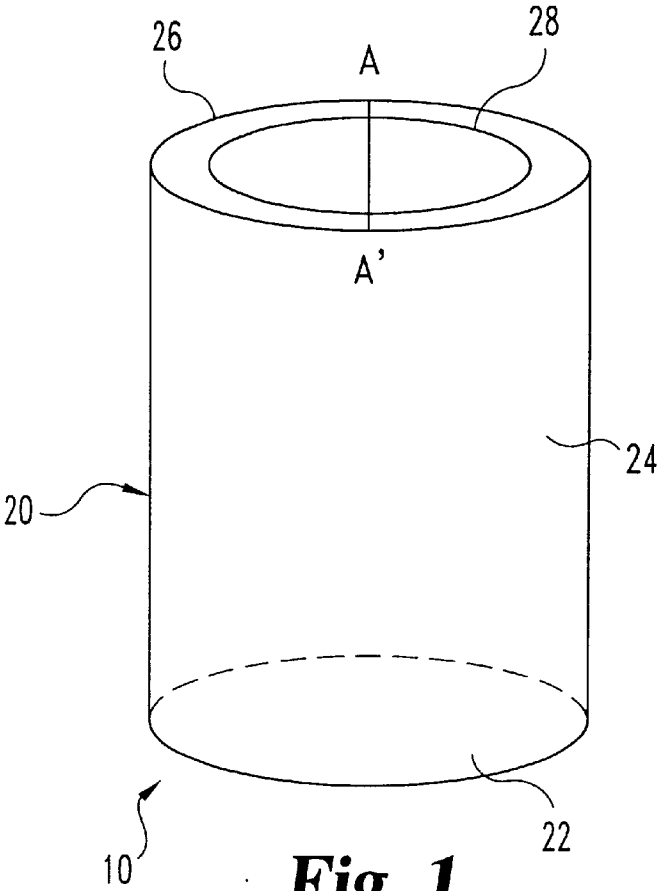
FIG. 1 is a perspective view of a crucible for containing molten metal of the present invention.
Figure 3:
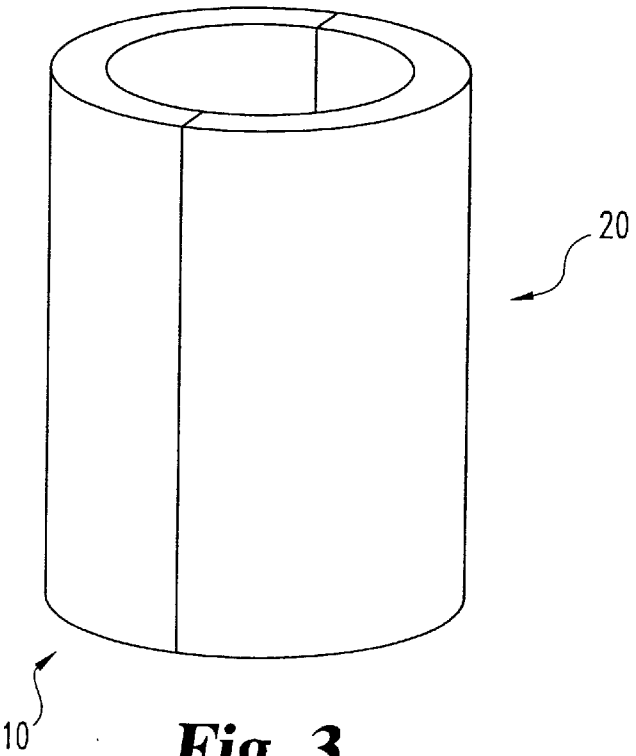
FIG. 3 is a perspective view of the bisected crucible of FIG. 1.
Figure 2B:
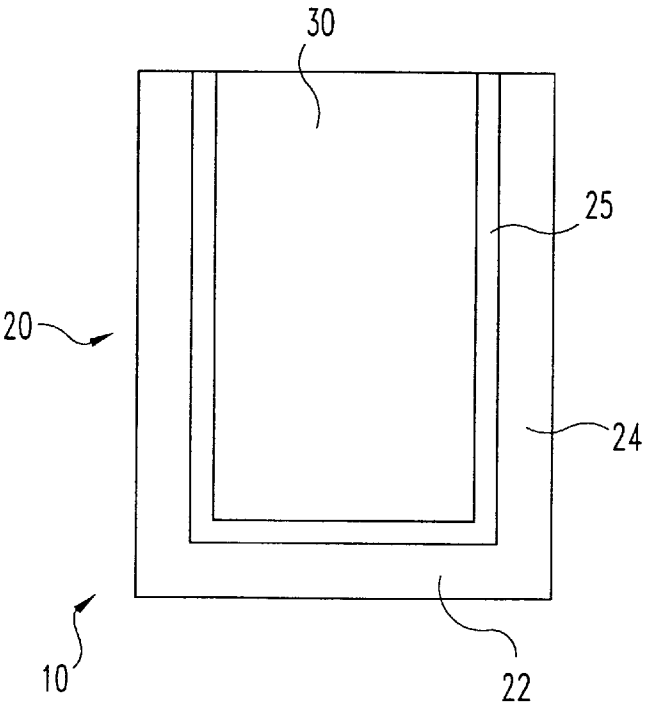
FIG. 2B is a sectional front elevational view of FIG. 1 including an inner liner and taken along line A–A'

FIGS. 1 and 2A–B illustrate a first embodiment of the present invention, a crucible assembly 10 for containing a quantity of molten metal, such as molten aluminum, for metallurgical processing. The crucible assembly 10 includes a refractory vessel or crucible 20. Crucible 20 is preferably cylindrical in shape, and is more preferably a right circular cylinder, although any convenient cross sectional shape (such as hexagonal or octagonal, for example) may be chosen. Additionally, the crucible 20 may include a draft angle of up to about 10°, with a draft angle of about 2° preferred. The inclusion of a draft angle aids in the emptying of the crucible 20, but likewise reduces the working volume of the crucible 20; therefore, a draft angle of less than about 10° is preferred. The crucible 20 preferably has a substantially flat circular bottom portion 22 and cylindrical sidewall 24 connected to the bottom portion 22 defining a right angle. The sidewall 24 has an outer surface 26 and an inner surface 28. A crucible inner volume 30 is defined by the bottom portion 22 and the inner surface 28 extending therefrom. The inner diameter of the crucible 20 is determined by the inner diameter of the receiving shot sleeve 63A (see FIGS. 8A–8B) minus the desired clearance required to drop the slurry billet 60A. It should be noted that the clearance preferably be kept small, so as not to introduce and trap air in the molten metal. The length of the crucible 20 is preferably sufficient to generate enough material to substantially satisfy the maximum capacity of a press. Typical size ranges for acceptable vessels or crucibles for the subject invention include lengths from about 1 inch to 35 inches and outside diameters from about 1 inch to 12 inches. The typical length to "width" aspect ratio is between 1.2:1 and 4:1.

The crucible 20 is preferably formed from a material suitable for containing a corrosive liquid metal at temperatures substantially above its melting point (for example, liquid aluminum at 700–800° C.) The crucible 20 is more preferably formed from a material such as graphite, stainless steel, or a suitable ceramic or ceramic composite composition. Since the crucible 20 must contain corrosive molten metals at elevated temperatures, it must necessarily be resistant to corrosion and have high strength at elevated temperatures. During thixotropic processing, the molten metals will be magnetically stirred, so the crucible 20 must also offer low resistance to penetration by the electromagnetic stirring fields. It is also preferred that the crucible 20 be a good thermal conductor (at least radially) so the liquid metal can be quickly and controlledly cooled by removal of heat from the sidewall outer surface 26.

One preferred crucible 20 material is a non-magnetic stainless steel composition (i.e., austenitic stainless steel). Stainless steels have relatively high thermal conductivity and high strength at elevated temperatures. Stainless steels can be coated with a ceramic or alloy layer to become resistant to corrosion from molten aluminum. Stainless steel compositions can be chosen to be non-magnetic, a property preferred for the crucible 20 since it is preferred that the crucible 20 have low resistance to penetration by magnetic flux. The high strength and toughness of a stainless steel produce a durable crucible 20.

It is possible to increase the corrosion resistance and decrease the adhesion of metal to the crucible inner wall 28 of a crucible 20 by adding an interior layer of corrosion resistant ceramic material, such as glassy-phase free polycrystalline alumina, zirconia or boron nitride. Some alloys, such as nickel-aluminum compositions, have also proven useful as crucible 20 coatings. The coating is preferably about 0.1 to 2 mm. thick. Alternately, a molten-aluminum-resistant graphitic or ceramic insert or sleeve 25 may be used with a stainless steel crucible 20 to provide corrosion resistance see FIG. 2B. The insert or sleeve may be bonded to the crucible 20, or it may be disposable, being removed from the crucible along with its contents after each processing run.

Graphite is another preferred crucible 20 material since, although it is porous, it is not wet by molten aluminum. Preferred grades of graphite include SES G10 and SES G20, although other convenient grades of graphite may be used. It should be noted that in general the specific characteristics of a given alloy composition may mandate the use of a different grade of graphite (or any crucible material) as the crucible 20. In other words, the specific physical properties required of a crucible 20 are a function of, among other parameters, the alloy composition desired to be contained as a liquid phase therein. Other such factors influencing crucible design include, but are not limited to, the range of operating temperatures, the speed of heating and/or cooling, the pH of the material to be contained in the crucible, the reactivity of the material with the crucible material, and cost.

Graphite is resistant to corrosion and with strength that increases with increasing temperature. Graphite also has a relatively low thermal expansion coefficient, high thermal shock resistance (due to a combination of high thermal conductivity and low Young's modulus) and high dimensional stability, making it attractive as a material for forming pieces that will be repeatedly thermally cycled. Graphite is an anisotropic material, best modeled as stacked planes (basal planes) of carbon atoms, with the bonds within the planes being extremely strong (about $9\times10^{12}$ dynes/cm$^2$ or $130\times10^6$ p.s.i.), stronger than the covalent bonds in diamond and contributing to a high longitudinal strength. The bonds between the planes are not as strong, and contribute to lower transverse strength. As used herein, "longitudinal" indicates a direction substantially within or parallel to the basal graphite plane and "transverse" indicates a direction substantially perpendicular to the basal graphite plane. The anisotropic physical properties of graphite may be exploited through the choice of graphite forming techniques. For example, extrusion tends to alight the anisotropic graphite crystallites along the axis of extrusion, resulting in a graphite piece with widely varying physical properties in the axial and transverse directions, while hot pressing from a powder precursor can yield a graphite piece with nearly isotropic physical properties. Careful attention to forming techniques allows fairly precise control of the degree of isotropy of the physical properties of the resulting graphite body.

Graphite also has the interesting physical property of actually increasing in strength with increasing temperature to about 2500° C. At about 800° C., a typical polycrystalline graphite member has a strength of 2800 dynes/cm$^2$. in the longitudinal direction and of about 1850 dynes/cm$^2$. in the transverse direction. The thermal conductivity of graphite is likewise anisotropic, with the thermal conductivity within the basal plane being about 1.3 cal/cm. sec.°C. at 800° C. and across basal planes being about 0.01 cal/cm. sec.°C. at 800° C. The thermal conductivity of polycrystalline graphite can therefore be tailored to be isotropic within a graphite body or highly anisotropic, as a function of the orientation of the constituent graphitic grains. The magnetoresistivity of graphite is isotropic and at elevated temperatures is negligible.

The primary drawback for using graphite as a crucible 20 material is that it is more brittle than steel and subject to cracking from impact or wear damage. This concern may be addressed by cladding or otherwise reinforcing the graphite crucible 20.

Another preferred material for forming the crucible is a ceramic composition resistant to attack by molten aluminum (such as polycrystalline $Al_2O_3$ formed without a glassy grain-boundary phase). Ceramic materials can be found that offer high strength at elevated temperatures, resistance to corrosion, and low magnetoresistivity. While many ceramic materials have low to moderate thermal conductivity, some can be found that have sufficiently high thermal conductivity to allow quick and controlled cooling of the molten metal. Nonporous ceramics or those with pores having very small diameters are preferred as crucibles 20, to decrease the adhesion of the cooling metal to the crucible inner wall 28. Like graphite, ceramic compositions tend to have the disadvantage of being brittle, although (like graphite) they may be reinforced, either through the addition of a reinforcing cladding or casing layer or as a ceramic composite material. Ceramic materials also have the disadvantage of having low thermal conductivities, making them (as a class) less attractive as crucibles 20, although certain ceramic materials and/or composites may be found with relatively high thermal conductivities.

The crucible 20 is preferably formed as a monolithic piece, but may also be formed from 2 or more pieces. For instance, FIGS. 3 and 13–15 show a crucible 20 formed from a pair of "clam-shell" crucible halves.

Figure 5A:
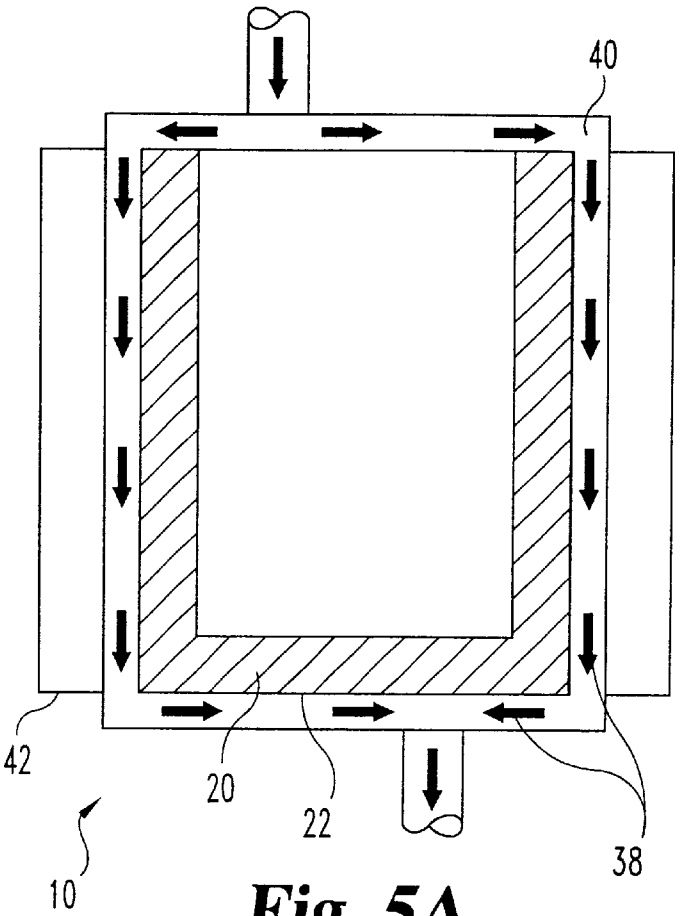
FIG. 5A is a sectional front elevational view of FIG. 2 positioned inside a thermal jacket and a stator assembly.
Figure 4A:
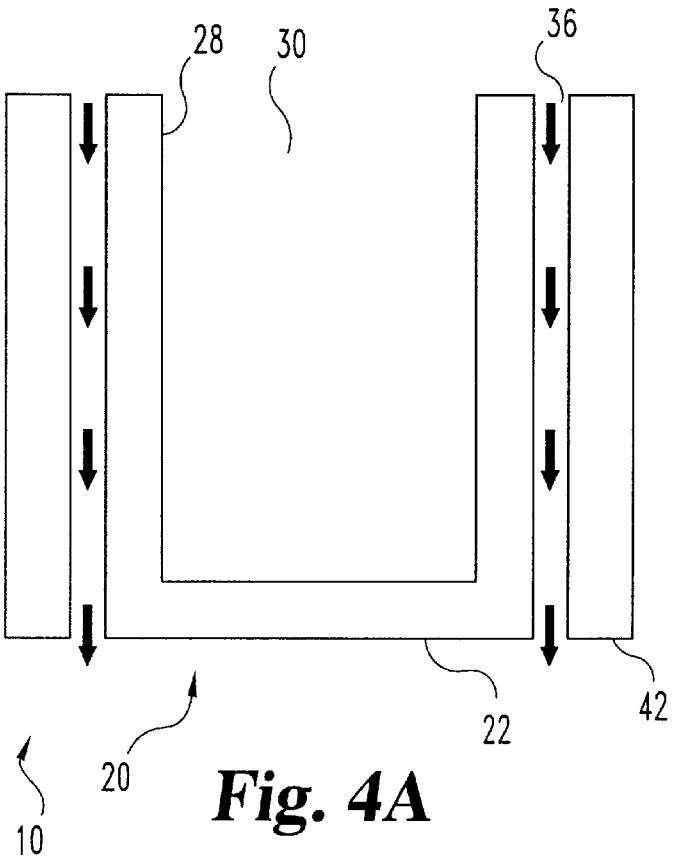
FIG. 4A is a sectional front elevational view of the embodiment of FIG. 2 positioned inside a fluid jacket and a stator assembly.
Figure 5B:
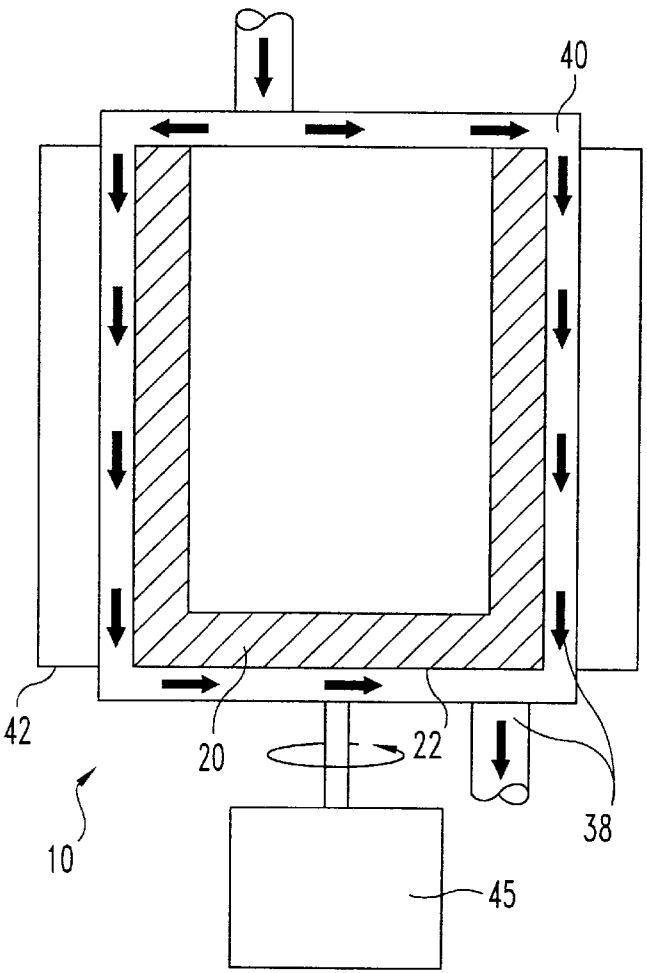
FIG. 5B is a sectional front elevational view of FIG. 5A adapted to rotate.
Figure 4B:
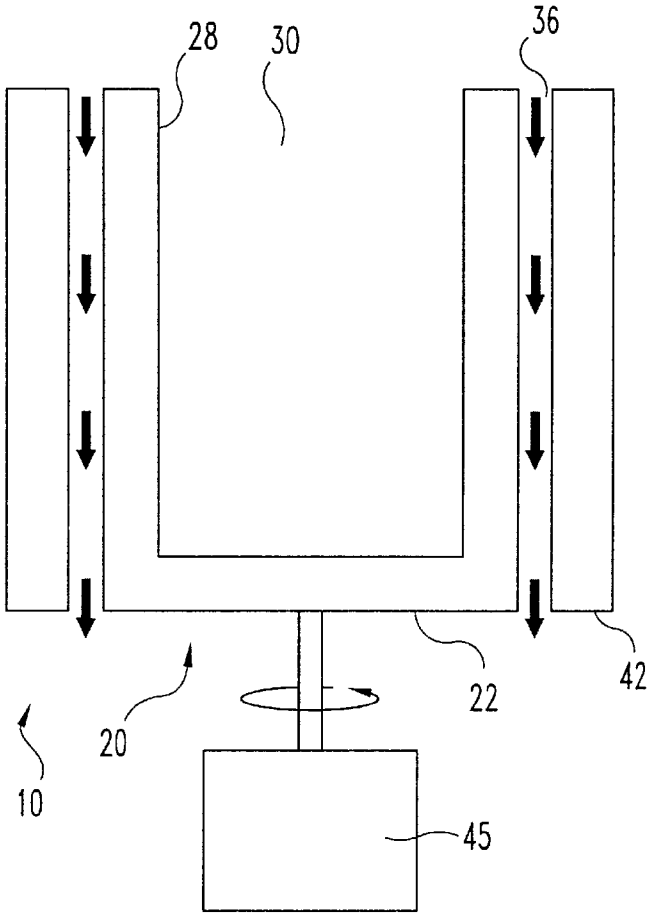
FIG. 4B is a sectional front elevational view of FIG. 4A adapted to rotate.

FIGS. 4A–4B and 5A–5B illustrate the crucible 20 connected to means for extracting thermal energy 36from the crucible 20, preferably a thermal jacket 36. In FIGS. 4A and 4B, the thermal jacket 36 is a curtain of flowing fluid 38, such as air or an inert gas (e.g., nitrogen), flowing around the crucible 20. In most cases, the thermal jacket 36 will be temperature controlled to be substantially cooler than the crucible 20 so as to quickly remove heat therefrom; however, the thermal jacket 36 may be warmed by a controlled heating element so as to become warmer than the crucible 20 to prevent the crucible 20 from being overcooled and to control the crucible's 20 temperature within a target range. In FIGS. 5A and 5B, the thermal jacket 36 includes a flowing fluid 38, such as air, water, or oil, constrained by a physical thermal vessel 40 positioned around the crucible 20 and placed into thermal communication therewith. The thermal vessel 40 may be unitary, or it may be formed from two or more interfitting pieces. As is shown in FIGS. 4A and 5A, the thermal jacket 36 is positioned between the crucible 20 and a stator assembly 42 for generating an electromagnetic field to produce a magnetomotive force on an electrically conducting liquid metal held in the crucible 20. A detailed thermal jacket design is provided in the related U.S. Patent Application Ser. No. 09/584,859 and attorney docket number 9105–5, filed on Jun. 1, 2000, by inventors Lombard and Wang, and is incorporated herein by reference.

FIGS. 4B and 5B illustrate an alternate embodiment of the present invention, wherein the crucible 20, the thermal jacket 36 and the stator assembly 42 are held stationary relative to one another and are adapted to rotate about a central axis of rotation 70. Rotation of the crucible 20, the thermal jacket 36 and the stator assembly 42 may be achieved through any convenient means, such as driver 45 operationally connected thereto.

Figure 6:
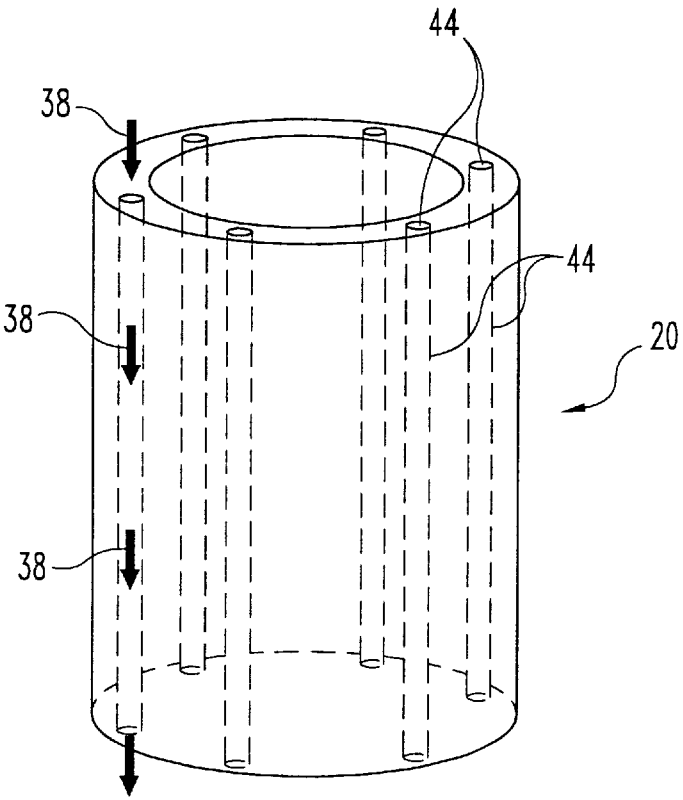
FIG. 6 is a perspective view of FIG. 1 including conduits formed through the crucible.

FIG. 6 illustrates a crucible 20 having conduits 44 formed integrally therein through which a flowing fluid 38 may be directed. The temperature of the crucible 20 may be precisely controlled by flowing a fluid 38 with a desired or predetermined temperature through the conduits 44 at a desired or predetermined rate. Preferably, the slurry billet (60A in FIGS. 8A and 8B and 60B in FIGS. 9A, 9B and 9C) is cooled at a rate of about 0.1° C. per second to 10° C. per second, and more preferably at a rate of about 0.5° C. per second to 5° C. per second. The cooling rate of the slurry billet is dependent upon how fast the slurry billet is stirred, and as such decreases as the slurry billet is cooled since the viscosity of the slurry billet increases rapidly as slurry billet temperature decreases.

Figure 7:
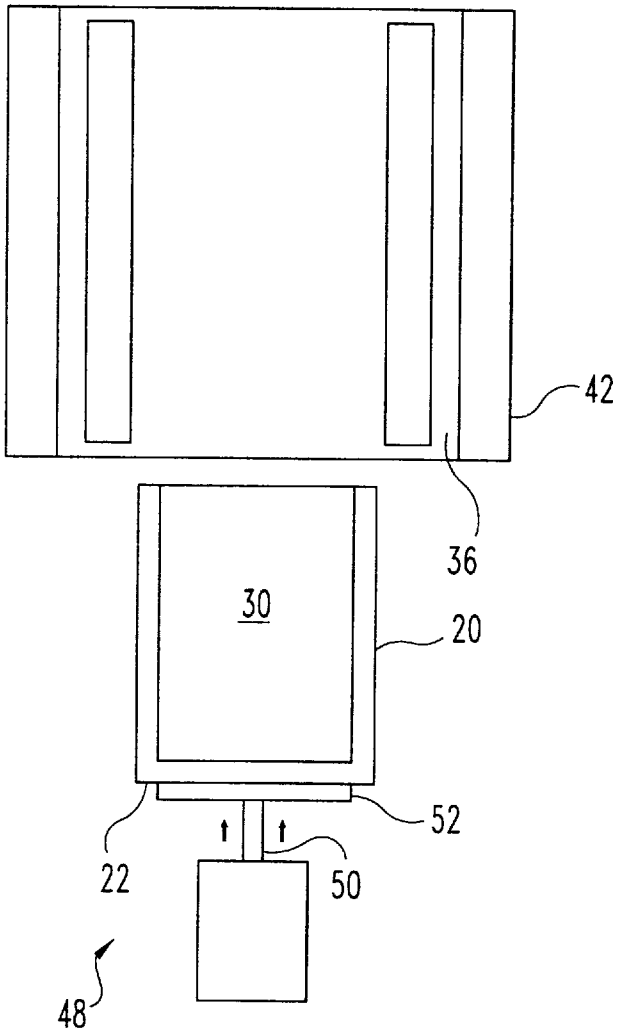
FIG. 7 is a sectional front elevational view of FIG. 2 illustrating the crucible mounted on an elevator platform below a stator assembly and thermal jacket.

FIG. 7 illustrates a positioning system 48 for emplacing the crucible 20 within the stator assembly 42 and the thermal jacket 36. The positioning system 48 includes a crucible raising piston 50 connected to a platform 52 upon which the crucible is positioned. Upon actuation of the crucible-raising piston 50, the platform 52 is raised, lifting the crucible towards the stator assembly 42 and the thermal jacket 36. The crucible 20 is oriented on the platform 52 such that as the platform 52 is raised, the crucible 20 is centeredly inserted into the thermal jacket 36 and the stator assembly 42.

Figure 8A:
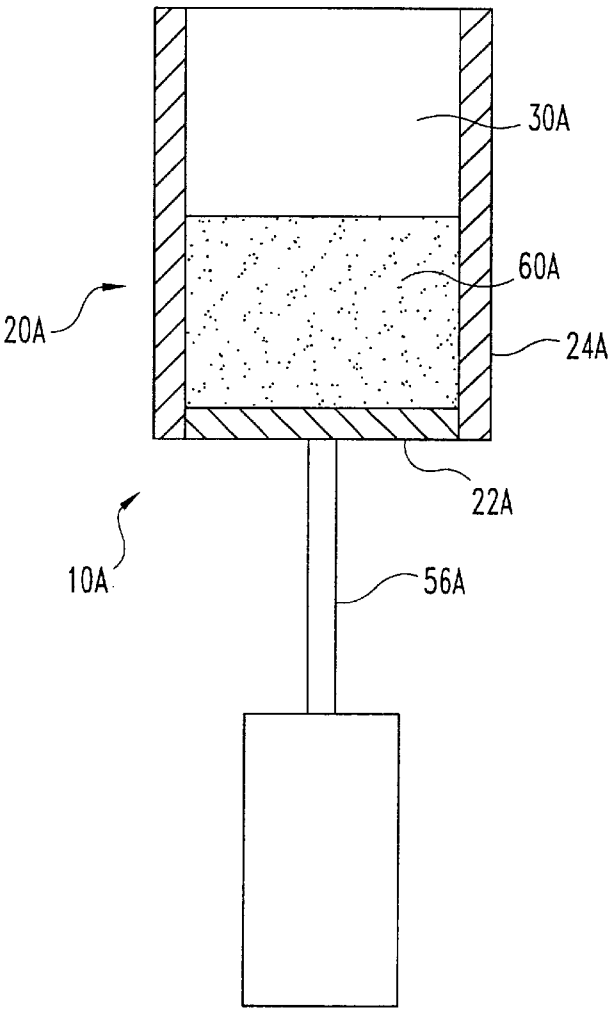
FIG. 8A is a sectional front elevational view of a second embodiment of the present invention, a crucible having a slidable bottom portion connected to a movable piston.
Figure 8B:
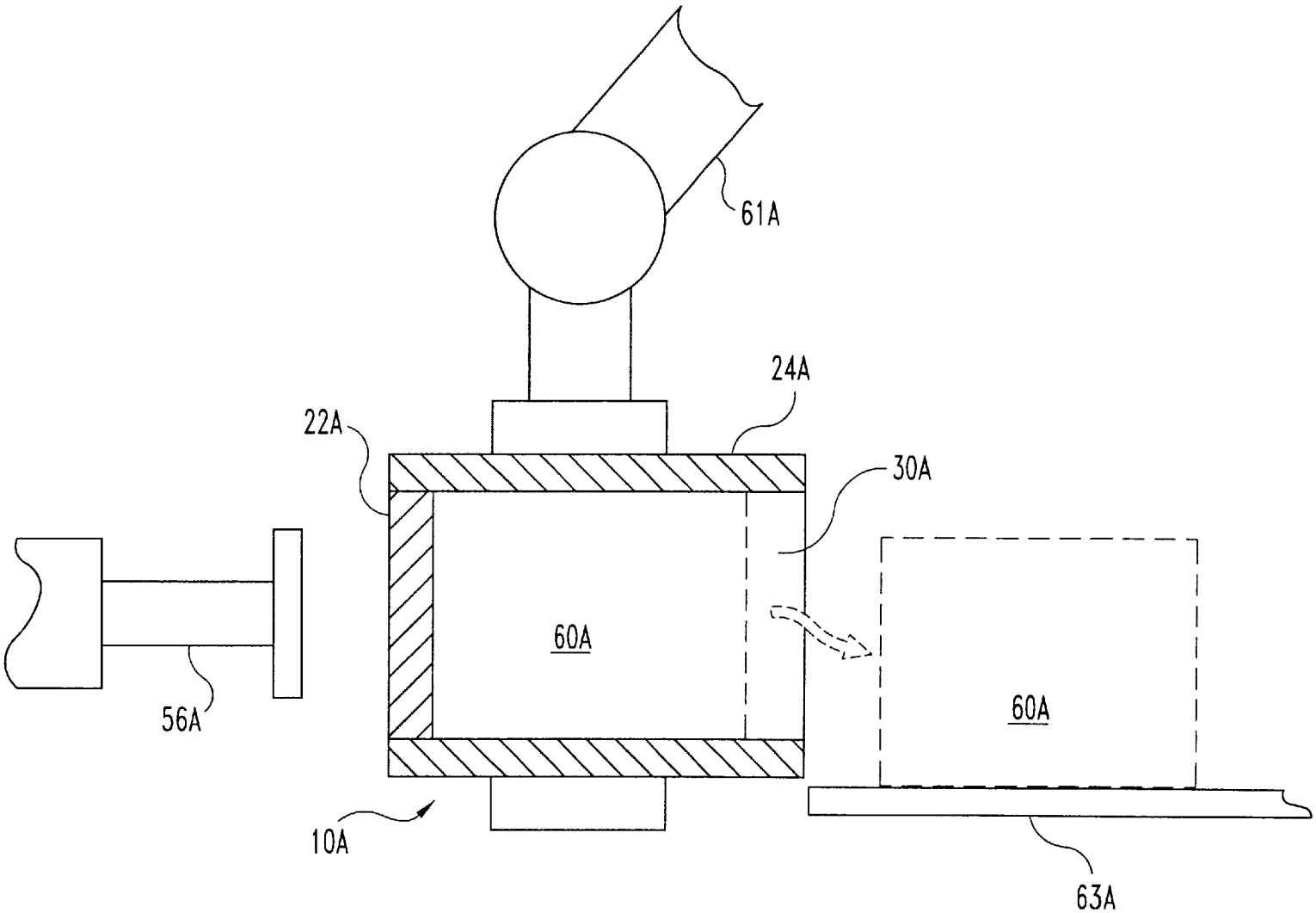
FIG. 8B is a sectional side elevational view of a second embodiment of the present invention, a crucible having a slideable bottom portion and engaged by a robot arm.

FIGS. 8A and 8B illustrate a second embodiment of the present invention, a crucible assembly 10A including a crucible 20A having a bottom portion 22A adapted to be movable axially through the sidewall 24A. The bottom portion 22A may be connected to an ejector piston 56A and is adapted to provide an ejecting force sufficient to move the bottom portion 22A axially through the crucible inner volume 30A, provided the sidewall 24A is constrained from so moving. A thixotropic slurry billet 60A contained within the crucible 20A will be discharged therefrom as the bottom portion 22A is forced axially through the mixing volume 30A. Alternately, the crucible 20*a* may be engaged by a robot arm 61A and repositioned to align the crucible bottom 22A with an ejector piston 56A and a shot sleeve 63A. Preferably, the crucible 20A is rotated 90° during repositioning such that the slurry billet 60A may be discharged horizontally, as illustrated in FIG. 8B. The ejector piston 56A is then actuated to discharge the slurry billet 60A onto the shot sleeve 63A.

Figure 9A:
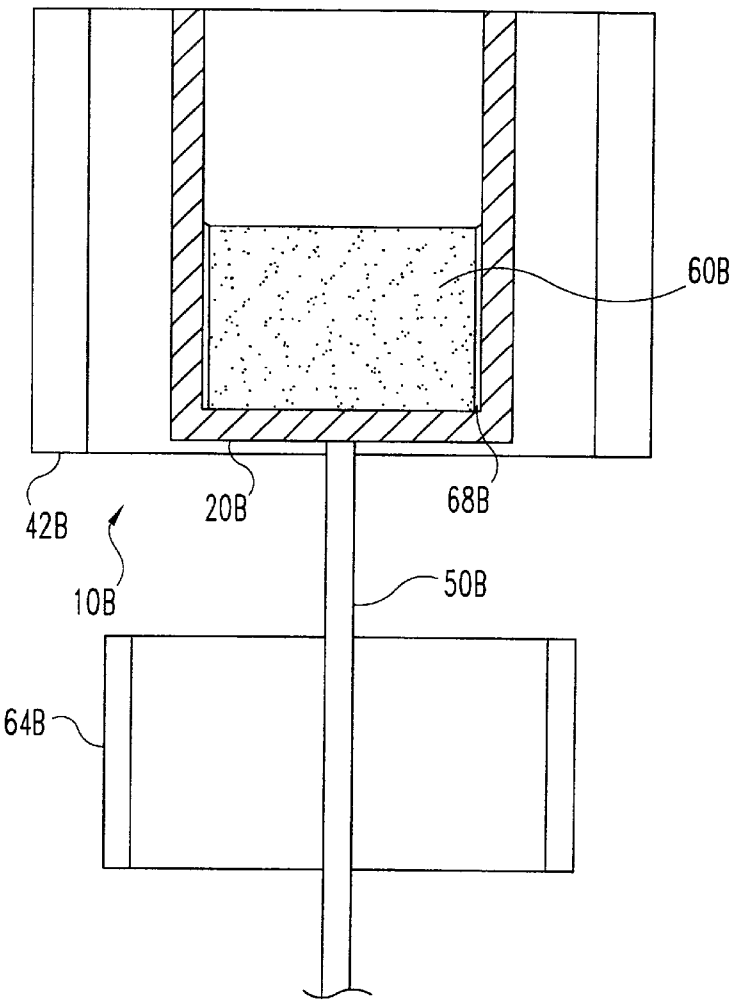
FIG. 9A is a sectional front elevational view of a third embodiment of the present invention, a crucible movably positioned between a solenoid coil and a stator assembly, with the crucible positioned within the stator assembly.
Figure 9B:
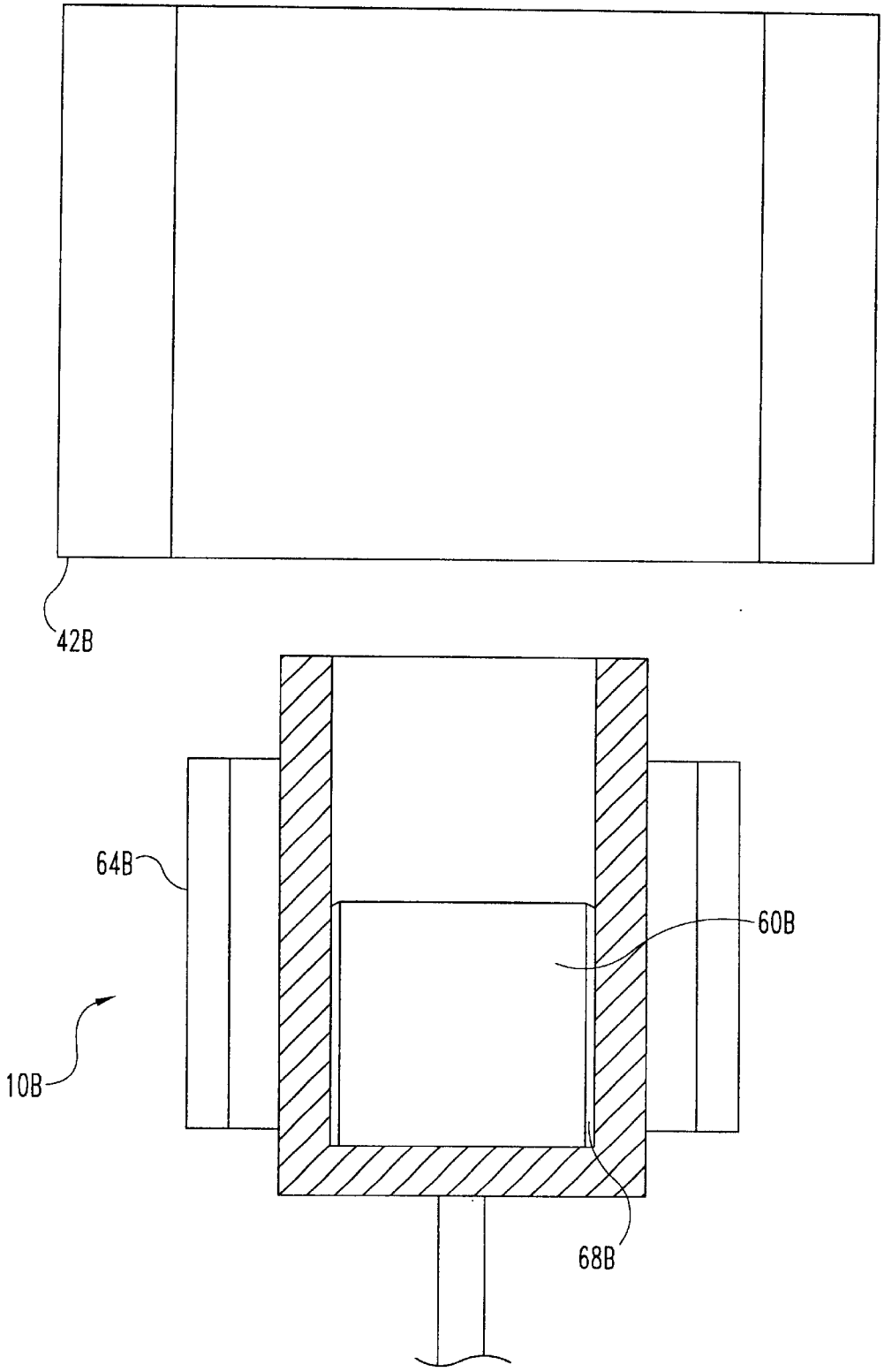
FIG. 9B is a sectional front view of the embodiment of FIG. 9A with the crucible positioned below the stator assembly and within a solenoid coil.
Figure 9C:
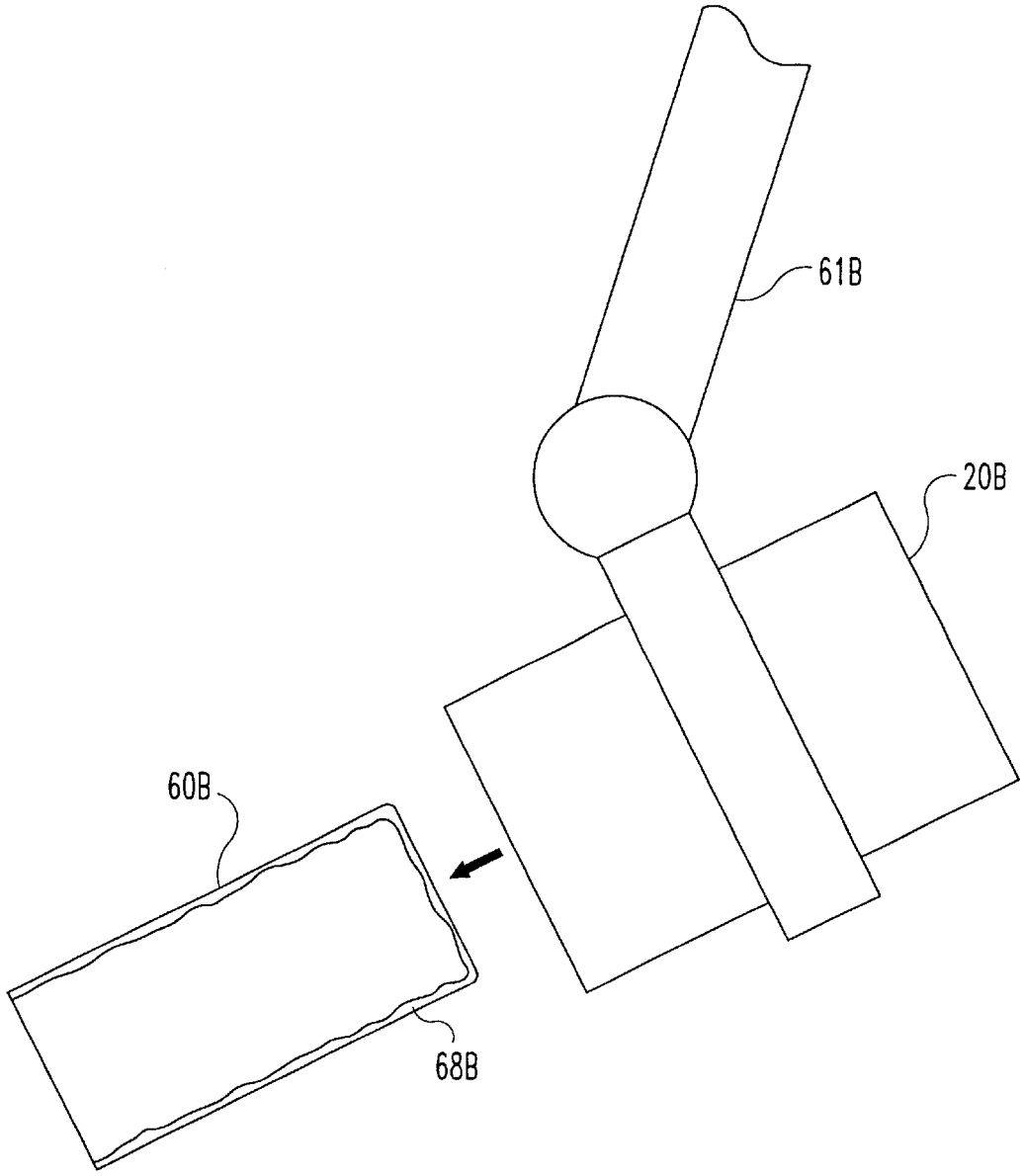
FIG. 9C is a side perspective view of the crucible of FIG. 9A engaged by a robot arm.

FIGS. 9A–9C show a third embodiment of the present invention, a crucible assembly 10B including a crucible 20B connected to an extendable crucible raising piston 50B and alternately positionable within a stator assembly 42B and an AC solenoid 64B, and movable therebetween. FIG. 9A illustrates the crucible raising piston 50B extended sufficiently to position the crucible 20B within the stator assembly 42B. In this position, a molten slurry billet 60B may be magnetically stirred upon actuation of the stator assembly 42B. FIG. 9B illustrates the crucible raising piston 50B retracted such that the crucible 20B is removed from the stator assembly 42B and positioned within a solenoid 64B. The solenoid 64B is preferably positioned surrounding the portion of the crucible 20B containing the slurry billet 60B, and is more preferably oriented coaxially with the crucible 20B. The solenoid 64B is electrically connected to an AC power source (not shown) capable of supplying high frequency AC current thereto.

In operation, actuation of the solenoid 64B induces rapidly alternating eddy currents in the outer skin 68B of an electrically conductive slurry billet 60B contained in the crucible 20B. The eddy currents give rise to Joule heating sufficient to melt the outer skin 68B and to break its possible bonding with the crucible 20B. At the same time, the electromagnetic field also generates a squeezing force on the slurry-billet 60B to separate it from the crucible 20B. Once the outer skin 68B is melted, the crucible 20B is tilted to discharge the slurry billet 60B therefrom with the molten metal skin 68B providing lubrication for the slurry billet 60B discharge as well as substantially preventing adhesion of the slurry billet 60B to the inner crucible wall 28B (thereby minimizing distortion of the slurry billet 60 and build-up of metal residue within the crucible 20B.) Preferably, discharge of the slurry billet 60B is performed gravitationally; i.e. the crucible is tilted to allow the slurry billet 60B to slide out. This is illustrated in FIG. 9C by a robot arm 61B tilting the crucible 20B to actuate a gravity discharge of the slurry billet 60B. Alternately, the crucible may be positioned on a hydraulically or mechanically actuated tiltable platform (see FIG. 8A) or tilted through any manner convenient to the embodiment.

Figure 10:
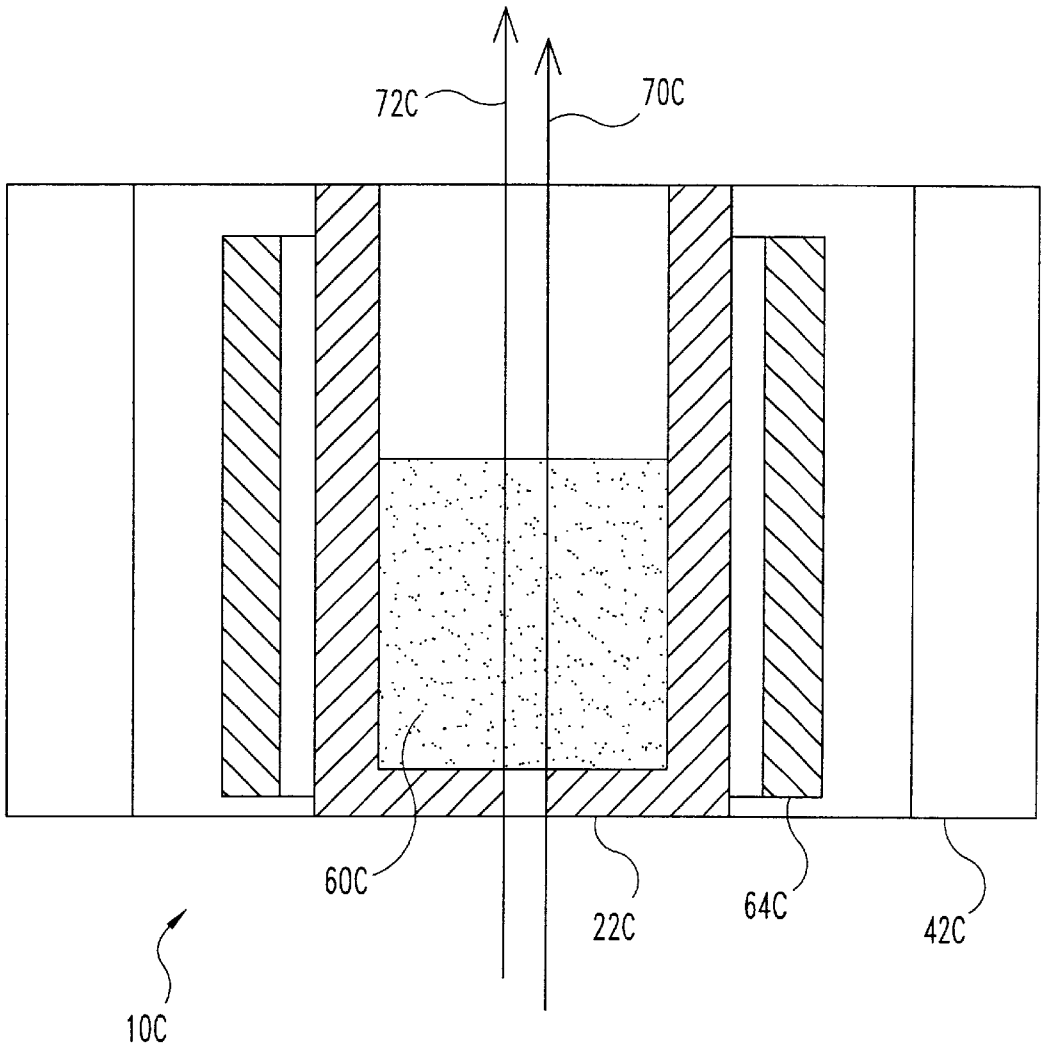
FIG. 10 is a sectional front elevational view of a fourth embodiment of the present invention, a crucible positioned within a solenoid coil and a stator assembly, with the solenoid coil positioned non-coaxially around the crucible.

FIG. 10 illustrates a forth embodiment of the present invention, a crucible assembly 10C including a crucible 20C positioned within a stator assembly 42C and having a solenoid 64C positioned around the crucible 20C. The crucible 20C has a crucible central axis of rotation 70C, and the solenoid 64C has a solenoid central axis of rotation 72C. The solenoid 64C is positioned relative the crucible 20C such that their respective central axes 70C, 72C are substantially parallel but non-collinear. The solenoid 64C is electrically connected to a power source (not shown.)

In operation, a variation of the technique known as electromagnetic forming is used to eject a billet 60C from the crucible 20C. Electromagnetic forming is a well-known metallurgical technique in which a burst of electromagnetic energy created by a brief high frequency discharge of high voltage electric energy through an inductive coil is used to generate an electromotive force. It comprises two variants, known respectively under the name of "magnetoforming" and "electroforming". In magnetoforming, an electromagnetic field propels a workpiece to be shaped (which must be at least partially electrically conducting metal) at high speed against another piece forming a die whose shape it assumes. In electroforming (also known as electro-hydraulic forming), an electric pulse is applied to an explosive wire placed in an insulating and incompressible medium. The explosion creates a shock wave that is transmitted through the incompressible medium to the piece to be shaped so as to cause expansion thereof.

In the magnetoforming process an electromagnetic field is produced by passing a time varying electric current through a coil (the workcoil). The current in the workcoil can be provided by the discharge of a capacitor (or more typically by a bank of capacitors) resulting in a pulse output. The workpiece can be maintained at a temperature so that it is somewhat malleable to aid the forming process, although this is not necessary. Various methods and apparatus are known for forming conductive materials through the use of electromagnetic pulses. Conventionally, such apparatus establishes a magnetic field of sufficiently high intensity and duration to create a high amperage electrical current pulse which when passed through a conductor in the form of a coil creates a pulse magnetic field of high intensity in the proximity of one or more selectively positioned conductive workpieces. A current pulse is thereby induced in the workpieces that interacts with the magnetic field to produce a force acting on the work pieces. When high magnitudes of electrical current are passed through the solenoid or coil, very high pressures are applied to the electrically conductive workpiece, and the electrically conductive workpiece is reduced in transverse dimensions.

In the instant case, a high voltage pulse is passed through the solenoid 64C to induce a pulse of current flowing in the opposite direction within the electrically conductive slurry billet 60C. As described above, very high electromagnetic pressures are generated in the transverse (radially inward) direction on the slurry billet 60C. Since the solenoid 64C and the crucible 20C (and therefore the slurry billet 60C within the crucible 20C) are not oriented coaxially, the compressive forces acting on the slurry billet 60C will not be radially symmetrically balanced, and a resultant axial force will be generated, forcing the deformable billet 60C out of the crucible 20C. This is roughly analogous to squeezing a wet bar of soap until it squirts out of your hand. Alternately, the solenoid 64C may be positioned coaxially with the crucible 20C. Upon pulsed actuation of the solenoid, the slurry billet 60C will be subjected to substantially symmetrical radially compressive forces. Since the slurry billet 60C is thixotropic and therefore deformable, the radially compressive forces will squeeze the slurry billet 60C, resulting in a net axial force upon the slurry billet 60C. Since the crucible 20C has a bottom portion 22C but no top portion, the net effect is that the slurry billet 60C will be squeezed from the crucible 20C. The crucible 20C is also preferably tilted to direct the emerging slurry billet 60C onto a desired resting surface, such as a shot sleeve or into a die.

Figure 11:
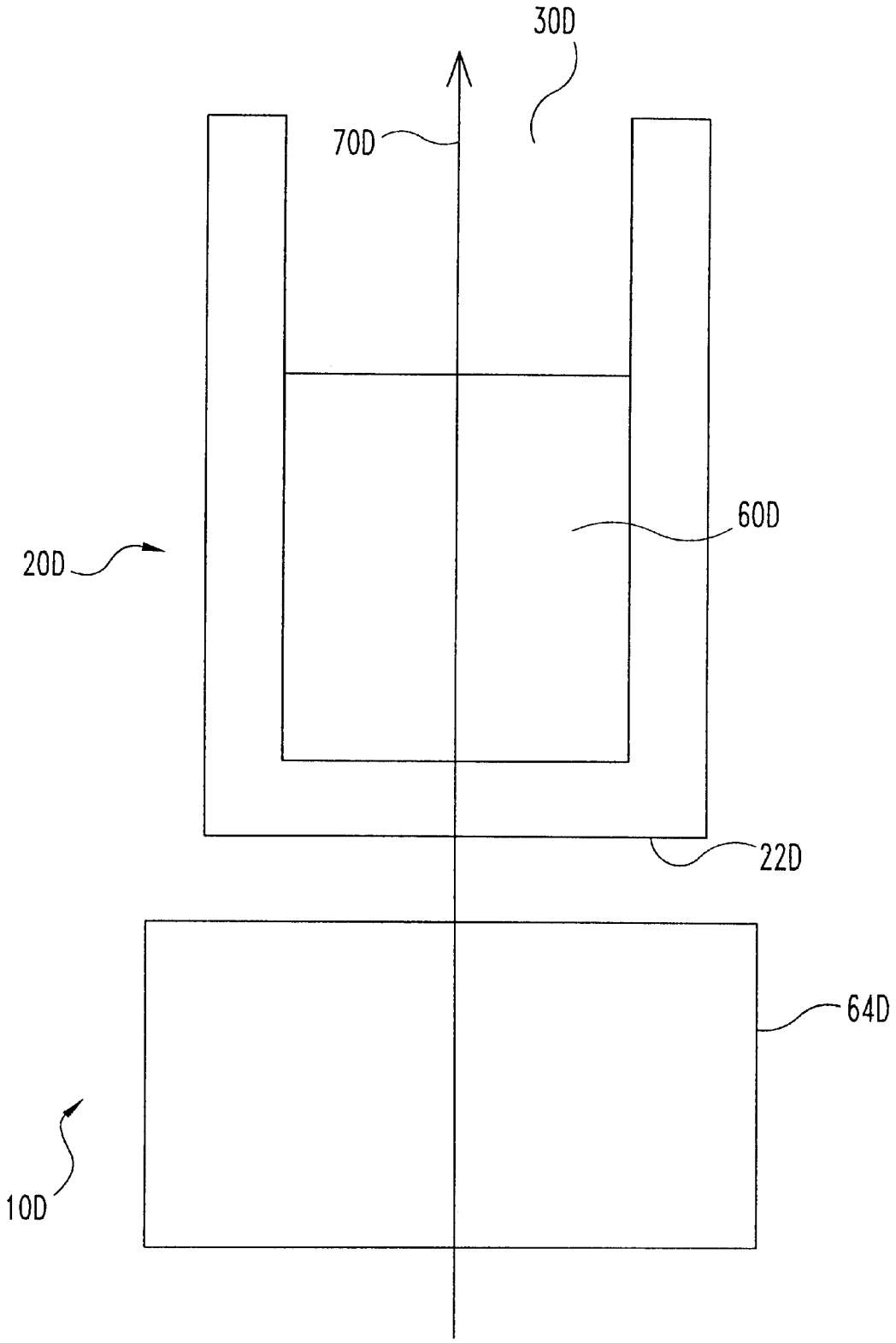
FIG. 11 is a sectional front elevational view of a fifth embodiment of the present invention, a crucible positioned above a solenoid coil.

FIG. 11 illustrates a fifth embodiment of the present invention, a crucible assembly 10D including a crucible 20D positioned substantially adjacent a solenoid 64D electrically connected to a high voltage source (not shown.) The solenoid 64D is preferably positioned substantially adjacent the bottom portion 22D of the crucible 20D. An electrically conducting billet 60D is contained in the crucible 20D, resting on the bottom portion 22D.

In operation, the solenoid 64D produces an electrical field pulse, inducing a pulse of current flowing in the opposite direction in the portion of the slurry billet 60D proximate the bottom portion 22D of the crucible 20D. The compressive forces so generated on the slurry billet 60D are therefore directed parallel to the crucible central axis of rotation 70D and away from the bottom portion 22D, and so urge the slurry billet 60D out of the crucible 20D.

Figure 12:
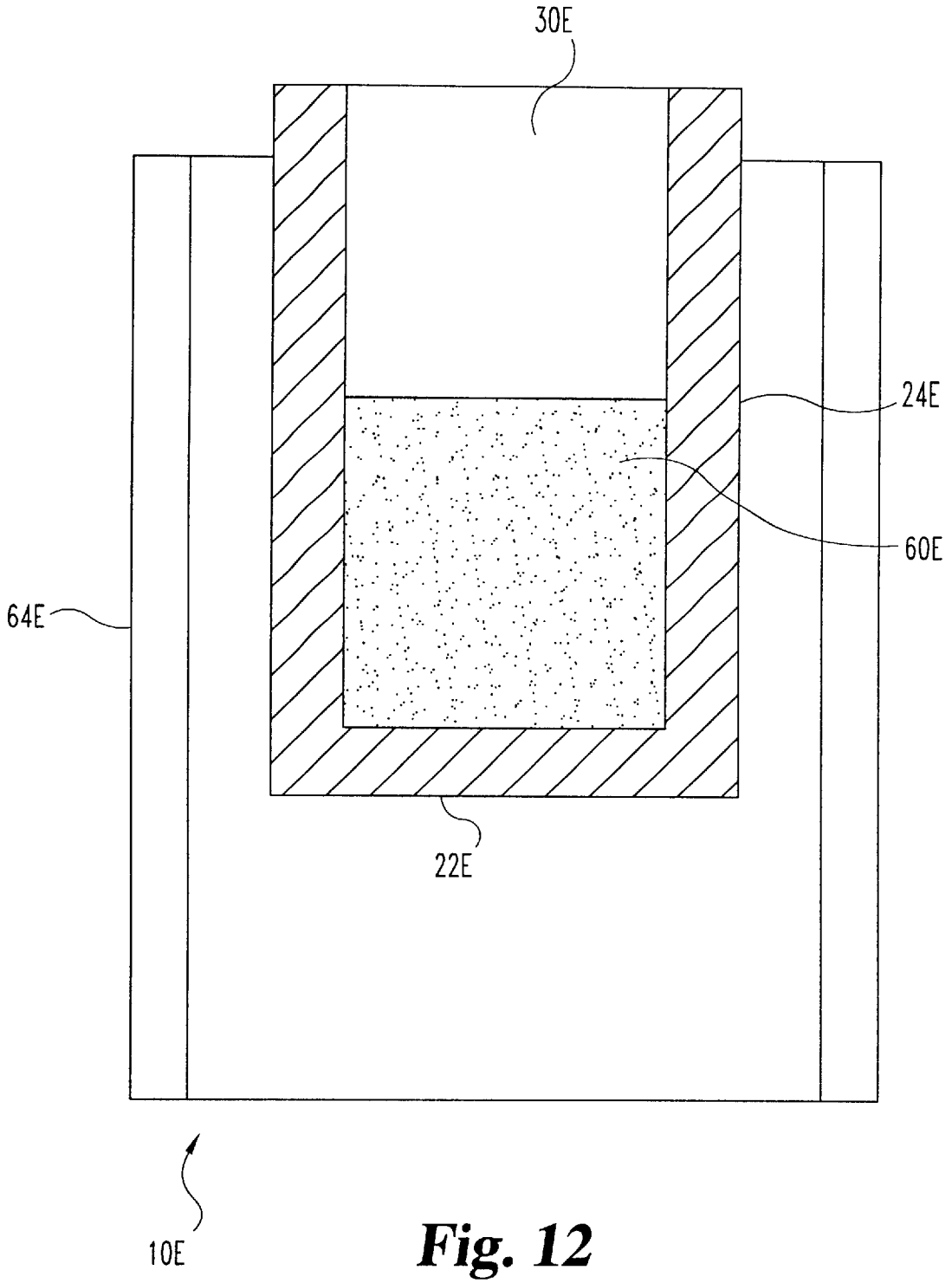
FIG. 12 is a sectional front view of a sixth embodiment of the present invention, a crucible positioned within an extended solenoid coil.

FIG. 12 illustrates a sixth embodiment of the present invention, a crucible assembly 10E including a crucible 20E positioned within a stator assembly 42E and having a solenoid 64E positioned around the crucible 20E and extending substantially beyond the crucible bottom 22E. The crucible 20E has a crucible central axis of rotation 70E, and the solenoid 64E has a solenoid central axis of rotation 72E. The axes 70E and 72E may or may not be collinear. The solenoid 64E is electrically connected to a power source (not shown.)

In operation, the solenoid 64E of the present embodiment combines the effects of the solenoids 64C, 64D of the fourth and fifth embodiments. When actuated, the solenoid 64E produces a high voltage electrical field pulse, inducing a pulse of current flowing in the opposite direction in the slurry billet 60E. The compressive forces so generated on the slurry billet 60E are therefore directed inwardly on the side and bottom surfaces of the slurry billet 60E. The combination of forces acting on the thixotropic slurry billet 60E produce a net force vector directed in a substantially axial direction away from the bottom portion 22E to urge the slurry billet 60E out of the crucible 20E.

Figure 13:
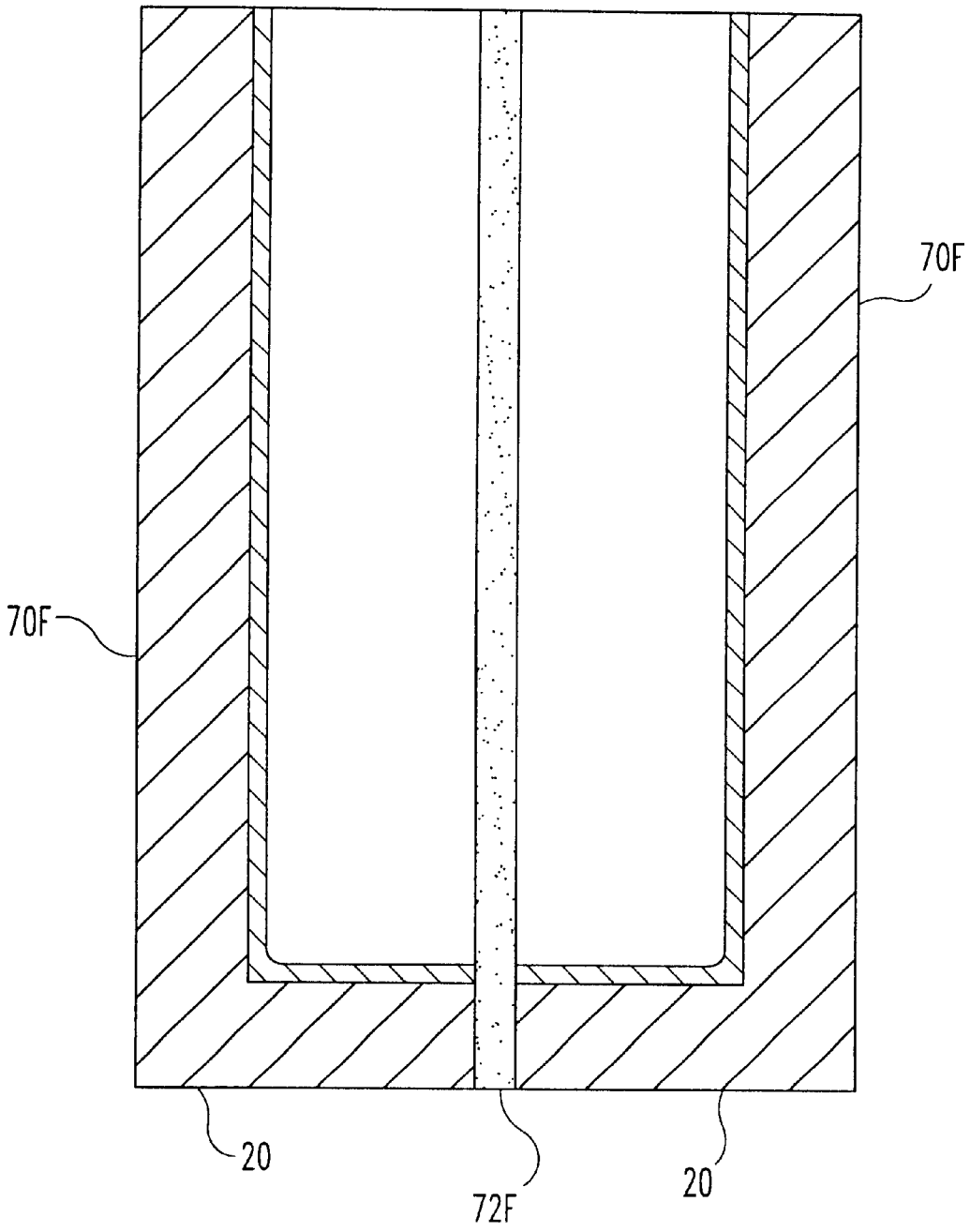
FIG. 13 is a front sectional view of a clamshell crucible with a dielectric layer positioned between the two crucible halves.
Figure 14A:
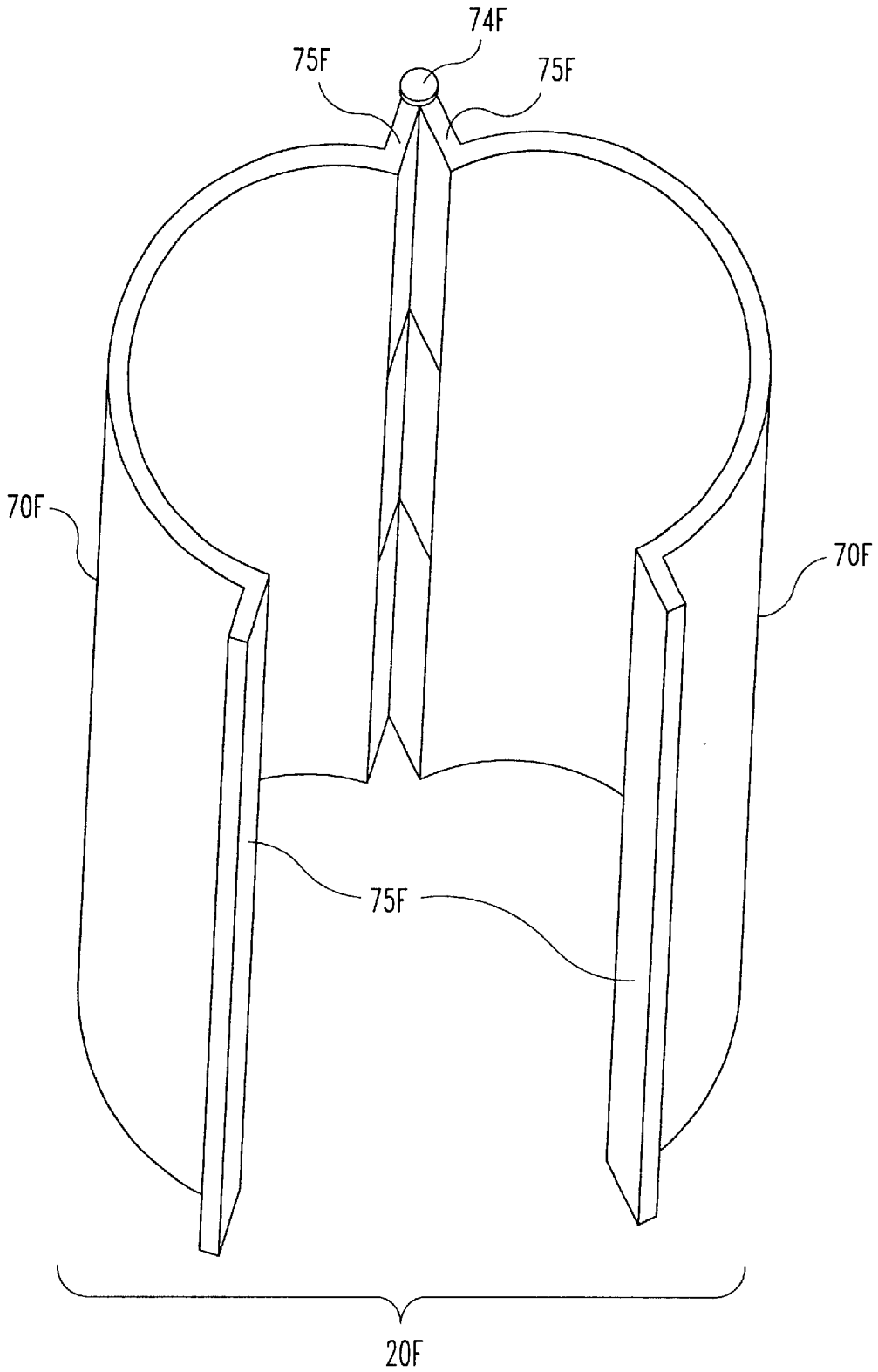
FIG. 14A is a perspective view of a partially opened hinged and flanged clamshell crucible according to the present invention.
Figure 14B:
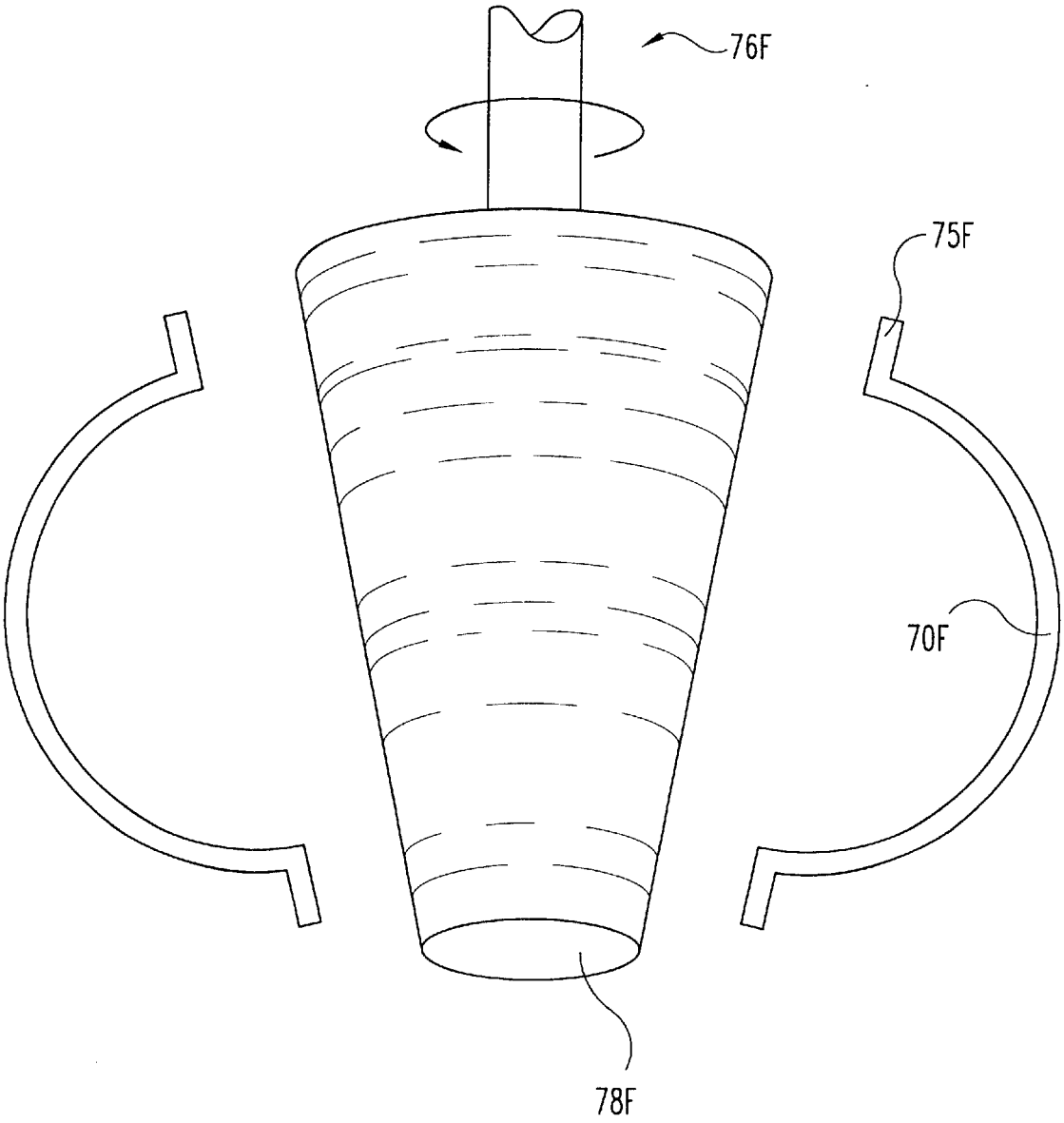
FIG. 14B is a perspective view of a rotatable cleaning brush designed for use with the crucible of FIG. 14A.
Figure 15:
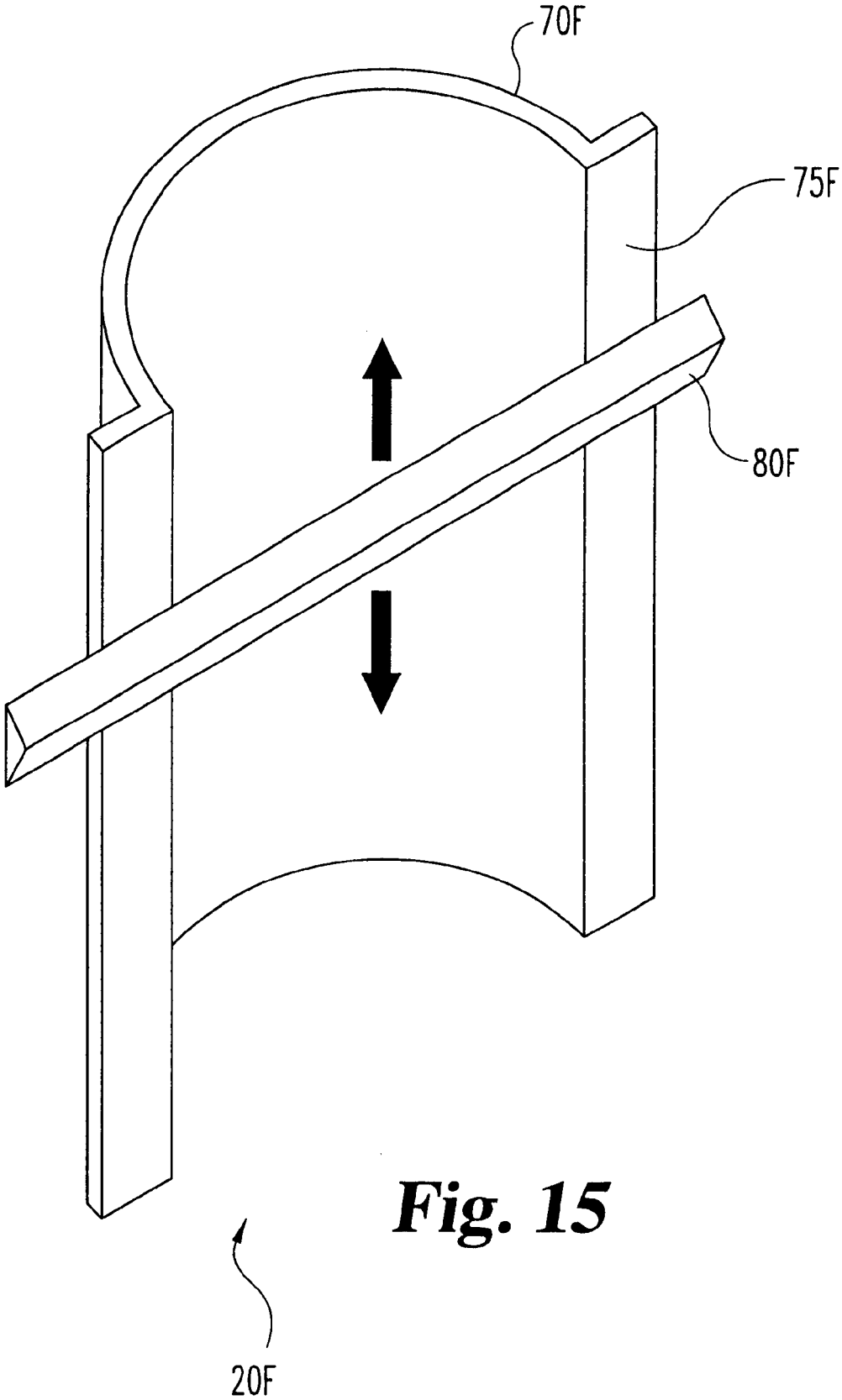
FIG. 15 is a perspective view flange scraper cleaningly engaging the flanges of a clamshell crucible half of FIG. 14A.

FIGS. 13–15 illustrate the clamshell crucible 20F variation in further detail. When used with a solenoid coil 64 for discharge, the crucible 20F is preferred to be formed from two crucible halves 70F with a dielectric layer 72F positioned on the inner diameter therebetween to prevent electrical communication therebetween, i.e. eddy currents induced in the crucible that might decrease the penetration of the electromotive field through the alloy. The dielectric layer 72F may be omitted if the crucible 20F is formed from an electrically insulating material.

FIG. 14 illustrates a clamshell crucible 20F including two virtually identical halves 70F. Each half 70F includes a pair of oppositely disposed flanges 75F. A hinge 74F pivotally connects the two flanged crucible halves 70F. FIG. 14A further illustrates a cooperating and rotatable cleaning brush 76F engagable to clean residual metal from the sealing surfaces of the crucible 20F. The cleaning brush preferably has a stainless steel bristle exterior surface 78F, although any convenient surface material capable of removing residual metal from the crucible 20F sealing surface may be used. The cleaning brush 76F preferably has a tapered diameter such that the sealing surfaces of the crucible can be cleaned by moving the rotating brush through the crucible in a minimum time.

In operation, the cleaning brush 76F is rotated sufficiently rapidly to impart enough kinetic energy to any residual metal adhering to the crucible 20F to cause its removal. The crucible 20F is preferably opened at a fixed angle to better facilitate cleaning. Preferably, the crucible 20F is cleaned after each cycle.

FIG. 15 illustrates an alternative crucible flange scraper 80F cleaningly engaging the flanges 75F of a crucible half 70F. The crucible flange scraper 80F is preferably made of a hard, tough material such as stainless steel or the like, and includes a flat scraping surface 81F adapted to scrapingly engage the flat flange surfaces 82F. The scraper 80F is moved back and forth over the flange 75F surfaces 82F until they are substantially free of any adhering metal. Alternately, the scraper 80F may be heated to soften any residue for ease of cleaning.

Figure 16:
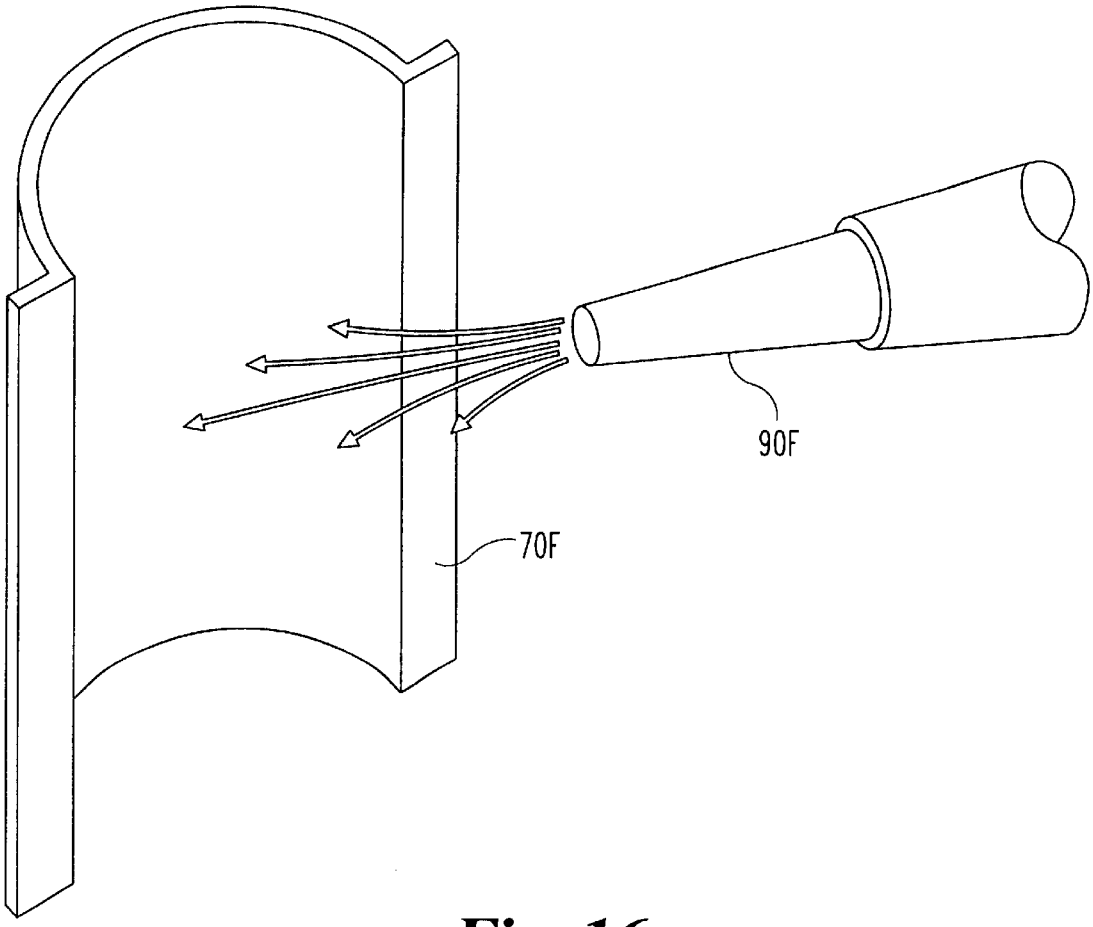
FIG. 16 is a perspective view of an air jet cleaningly engaging the flanges of a crucible half of FIG. 14A.

FIG. 16 illustrates another alternative crucible-cleaning device, an air-jet 90F adapted to blow metallic residue from the crucible halves 70F.

Figure 17A:
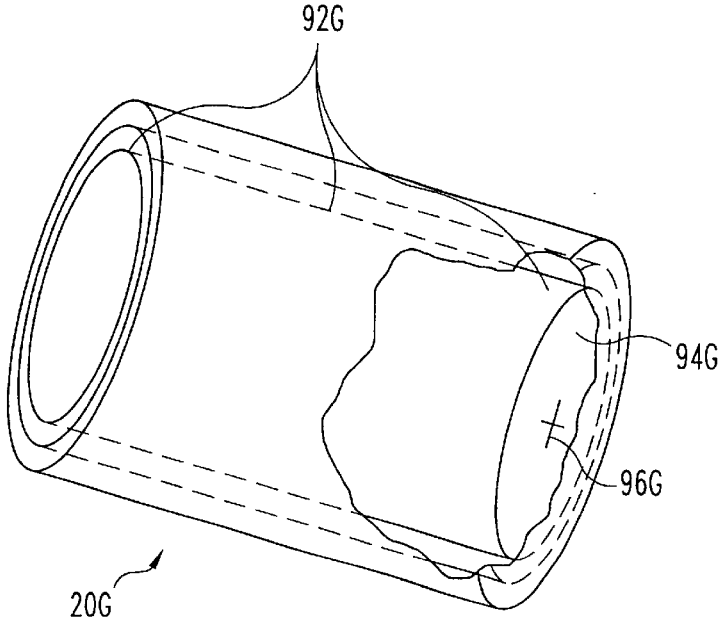
FIG. 17A is a partial perspective cutaway view of a crucible having a disposable interior liner.

FIGS. 17A and B illustrate yet another alternative crucible design, a crucible 20G having a disposable portion 92G adapted to be ejected while fully loaded with a prepared slurry billet onto a shot sleeve or the like (not shown). Referring to FIG. 17A, the crucible 20G includes a disposable inner liner 92G adapted to fit within the crucible 20G. The disposable inner liner 92G further includes a scored bottom portion 94G. When ejected, the liner 92G contains the thixotropic slurry billet until axial pressure is applied thereto, such as from a plunger pushing on the slurry billet. When sufficient pressure is applied to the slurry billet, the scored bottom portion 94G splits along the scoring 96G, allowing the slurry billet to be readily removed from the lining. The disposable inner liner 92G is preferably made from a lightweight malleable material resistant to attack from molten aluminum and is more preferably made from an aluminum allow having a sufficiently high melting point to contain the slurry billet during its preparation and handling.

Figure 17B:
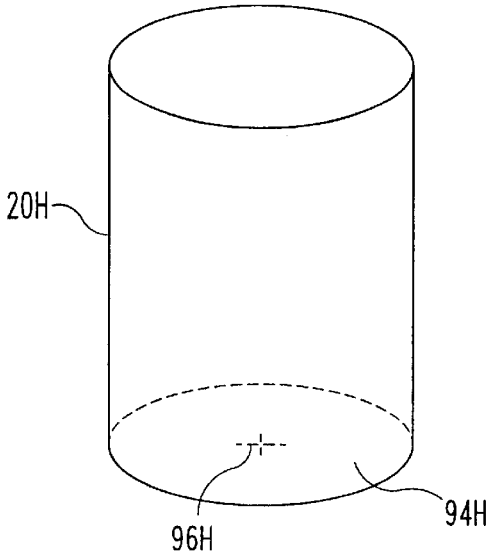
FIG. 17B is a perspective view of a disposable crucible.

FIG. 17B illustrates an alternate form of the above invention, a disposable crucible 20H. The disposable crucible 20H is similar to the above-discussed crucible 20G, with the difference that the disposable crucible 20H combines the crucible 20G and liner 92G aspects into one vessel 20H. As above, the disposable crucible 20H includes a scored bottom portion 94H. When ejected, the disposable crucible 20H contains the thixotropic slurry billet (not shown) until axial pressure is applied thereto, such as from a plunger pushing on the slurry billet. When sufficient pressure is applied to the slurry billet, the scored bottom portion 94H splits along the scoring 96H, allowing the slurry billet to be readily removed from the lining. The disposable crucible 20H is preferably made from a lightweight malleable material resistant to attack from molten aluminum and is more preferably made from an aluminum allow having a sufficiently high melting point to contain the slurry billet during its preparation and handling.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

We claim:

1. A system for processing a thixotropic metallic melt, comprising:

a vessel for containing a molten metallic composition and having a vessel top end and an enclosed vessel bottom end;

means to extract thermal energy from the vessel; and means for ejecting the contents of the vessel;

wherein the vessel has a central axis and wherein the means for ejecting the contents of the vessel further comprise:

a solenoid having a solenoid axis and positioned around the vessel; and a voltage source electrically connected to the solenoid and adapted to provide a high frequency a.c. current therethrough;

wherein the solenoid axis is oriented substantially parallel to central axis; and wherein actuation of the solenoid develops and ejecting force acting on a molten metallic composition contained in the vessel sufficient to eject the molten metallic composition from the vessel.

2. A system for containing molten aluminum during thixotropic processing, comprising:

a substantially cylindrical crucible having an open crucible top, a closed crucible bottom, a cylindrical crucible wall extending from the crucible bottom to the crucible top and defining a mixing volume therein, and a crucible central axis extending through the mixing volume substantially parallel to the crucible wall;

a thermal jacket surrounding the crucible wall and in thermal communication therewith; and an electric coil positioned in electromagnetic communication with said crucible for generating an electric field within said crucible;

wherein the electric coil has an electric coil axis extending therethrough;

wherein the electric coil axis is oriented substantially parallel to the crucible central axis;

wherein the electric coil axis is non-collinear with the crucible central axis; and wherein actuation of the electric coil induces a radial force on a conductor within the mixing volume and adjacent the crucible wall sufficient to force the conductor away from the crucible wall and urge the conductor towards the open crucible top.

3. A system for containing molten aluminum during thixotropic processing, comprising:

a substantially cylindrical crucible having an open crucible top, a crucible bottom, a cylindrical crucible wall extending from the crucible bottom to the crucible top and defining a mixing volume therein, and a crucible central axis extending through the mixing volume substantially parallel to the crucible wall;

a thermal jacket surrounding the crucible wall and in thermal communication therewith; and an electric coil positioned in electromagnetic communication with said crucible for generating an electric field within said crucible;

wherein the electric coil has an electric coil axis extending therethrough;

wherein the electric coil axis is oriented substantially parallel to the crucible central axis;

wherein the electric coil axis is substantially collinear with the crucible central axis; and wherein actuation of the electric coil induces a radial body force pushing inwardly within the alloy volume adjacent to the crucible wall sufficient to compress the alloy volume away from the crucible wall.

4. The apparatus of claim 2 wherein actuation of the electric coil produces an electromotive force penetrating the crucible, acting on a conductor within the crucible and directed towards the crucible top.

5. The apparatus of claim 3 wherein the electric coil extends beyond the bottom of the crucible and wherein actuation of the electric coil produces an electromotive force acting directly on the alloy and directed towards the crucible top.

6. A system for containing molten aluminum during thixotropic processing, comprising:

a substantially cylindrical crucible having an open crucible top, a crucible bottom, a cylindrical crucible wall extending from the crucible bottom to the crucible top and defining a mixing volume therein, and a crucible central axis extending through the mixing volume substantially parallel to the crucible wall;

a body of molten aluminum contained within the crucible;

a thermal jacket surrounding the crucible wall and in thermal communication therewith; and an electric coil positioned in electromagnetic communication with said crucible for generating an electric field within said crucible;

a movable crucible bottom portion adapted to slide within the mixing volume; and a piston connected to the movable crucible bottom and positioned parallel to the crucible central axis;

wherein the electric coil has an electric coil axis extending therethrough;

wherein the electric coil axis is oriented substantially parallel to the crucible central axis;

wherein the electric coil may be actuated to produce an inwardly acting radial force on the body of molten aluminum contained within the crucible sufficient to distort the body of molten aluminum; and wherein actuation of the piston slides the movable bottom portion within the mixing volume.

7. The apparatus of claim 6 wherein the piston is self-lubricating.

8. The apparatus of claim 6 wherein the piston is a ceramic.

9. A system for containing a thixotropic molten aluminum alloy, comprising:

a crucible adapted to contain molten aluminum;

a thermal control assembly connected to the crucible in thermal communication therewith; and an electromotive purging assembly connected to the crucible for removing the contents thereof;

wherein the crucible has a top end and a bottom end;

wherein the electromotive purging assembly further includes an electric coil wrapped around said crucible and extending beyond the bottom end; and wherein actuation of the electromotive purging assembly produces a compressive electromotive inductance field within the crucible in the direction of the top end.

10. The system of claim 9 wherein the thermal control assembly includes a thermal jacket in thermal communication with the crucible.

11. A metallic melt processing containment apparatus, comprising:

a crucible adapted to contain a metal melt;

means for controlledly exchanging heat with a crucible; and means for removing a metallic mass from within said crucible;

wherein the crucible includes a scored bottom portion, wherein the crucible is adapted to be removed with a load, and wherein the scored bottom portion is adapted to be split to facilitate removal of the load.

12. The system of claim 1 wherein the solenoid axis is substantially collinear with the central axis.

13. The system of claim 1 wherein the solenoid axis is substantially non-collinear with the central axis.

* * * * *